US009878546B2

(12) United States Patent
Yamanobe

(10) Patent No.: US 9,878,546 B2
(45) Date of Patent: Jan. 30, 2018

(54) LIQUID EJECTION DEVICE AND CLEANING METHOD

(71) Applicant: FUJIFILM Corporation, Tokyo (JP)

(72) Inventor: Jun Yamanobe, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/428,148

(22) Filed: Feb. 9, 2017

(65) Prior Publication Data

US 2017/0225471 A1 Aug. 10, 2017

(30) Foreign Application Priority Data

Feb. 10, 2016 (JP) ..... 2016-024024

(51) Int. Cl.
*B41J 2/165* (2006.01)

(52) U.S. Cl.
CPC ..... *B41J 2/16535* (2013.01); *B41J 2/16544* (2013.01); *B41J 2/16588* (2013.01); *B41J 2002/1655* (2013.01); *B41J 2002/16558* (2013.01)

(58) Field of Classification Search
CPC . B41J 2/16535; B41J 2/16544; B41J 2/16588
See application file for complete search history.

(56) References Cited

U.S. PATENT DOCUMENTS

| | | | | |
|---|---|---|---|---|
| 9,254,665 | B2 | 2/2016 | Shinoto et al. | |
| 2013/0176362 | A1* | 7/2013 | Inoue | B41J 2/16535 347/33 |
| 2013/0187979 | A1* | 7/2013 | Bernard | B41J 2/16538 347/33 |
| 2014/0253632 | A1* | 9/2014 | Matsumoto | B41J 2/1652 347/33 |

FOREIGN PATENT DOCUMENTS

| | | |
|---|---|---|
| JP | 2011067985 | 4/2011 |
| JP | 2015112725 | 6/2015 |

OTHER PUBLICATIONS

"Search Report of Europe Counterpart Application", dated Jul. 25, 2017, p. 1-p. 8.

* cited by examiner

*Primary Examiner* — Jason Uhlenhake
(74) *Attorney, Agent, or Firm* — JCIPRNET

(57) ABSTRACT

When a liquid ejection head and a first wiping unit are moved relatively to clean a surface, the first wiping unit making a first wiping member travel in a first direction, a direction opposite to the first direction is used as a moving direction of the head with reference to the first wiping member in relative moving therebetween. When the head and a second wiping unit are moved relatively to each other to clean the surface, the second wiping unit making a second wiping member travel in a second direction having a component of a direction opposite to the first direction, a direction opposite to the second direction is used as a moving direction of the head with reference to the second wiping member in relative moving therebetween to move the second wiping unit and the head relatively to clean the same area on the surface.

15 Claims, 17 Drawing Sheets

LIQUID EJECTION DEVICE AND CLEANING METHOD

CROSS-REFERENCE TO RELATED APPLICATIONS

The present application claims priority under 35 U.S.C. § 119 to Japanese Patent Application No. 2016-024024, filed on Feb. 10, 2016. The above application is hereby expressly incorporated by reference, in its entirety, into the present application.

BACKGROUND OF THE INVENTION

Field of the Invention

The present invention relates to a liquid ejection device and a cleaning method, and particularly to maintenance technology for a liquid ejection head.

Description of the Related Art

There has been known a maintenance method, for a liquid ejection device having an inkjet printing liquid ejection head, in which a wiping member such as a web is used to wipe an ejecting surface of a liquid ejection head.

Japanese Patent Application Laid-Open No. 2011-067985 describes a wiping unit for wiping an ejecting surface of a liquid ejection head. The wiping unit described in Japanese Patent Application Laid-Open No. 2011-067985 has a configuration in which a web is brought into contact with the ejecting surface of the liquid ejection head to move the web in a direction opposite to a direction that moves the liquid ejection head and wipe the ejecting surface of the liquid ejection head.

The term "wiping unit" used herein corresponds to a line head cleaning device in Japanese Patent Application Laid-Open No. 2011-067985. The term "web" used herein corresponds to a term "wiping web" in Japanese Patent Application Laid-Open No. 2011-067985. Traveling of the web herein corresponds to conveying of the wiping web in Japanese Patent Application Laid-Open No. 2011-067985.

Japanese Patent Application Laid-Open No. 2015-112725 describes a wiping unit for wiping an ejecting surface of a liquid ejection head. The wiping unit described in Japanese Patent Application Laid-Open No. 2015-112725 is provided to an inkjet recording apparatus having a serial printing liquid ejection head.

The wiping unit described in Japanese Patent Application Laid-Open No. 2015-112725, which is a wiping unit for wiping in a first direction perpendicular to both a moving direction and a vertical direction or in a second direction opposite to the first direction, wipes in the first direction a first wiping area on an ejecting surface and wipes in the second direction a second wiping area located at a position different from the first wiping area in the moving direction.

The term "liquid ejection head" used herein corresponds to a term "liquid ejection section" in Japanese Patent Application Laid-Open No. 2015-112725. The term "ejecting surface" used herein corresponds to a term "nozzle opening area" in Japanese Patent Application Laid-Open No. 2015-112725.

SUMMARY OF THE INVENTION

However, the wiping unit described in Japanese Patent Application Laid-Open No. 2011-067985 and the wiping unit described in Japanese Patent Application Laid-Open No. 2015-112725 always wipe from only one direction with respect to an ejection opening, which results in that an un-wiped portion is given biasedly to one side of the ejection opening to cause ejection bending.

Particularly, the un-wiped portion biasedly given when wiping a line type liquid ejection head along a longitudinal direction causes the ejection bending in the line type liquid ejection head in the longitudinal direction to generate a stripe-like unevenness on a formed image.

The present invention has been made in consideration of such a circumstance, and has an object to provide a liquid ejection device for attaining a stable cleaning of an ejecting surface and a cleaning method.

In order to achieve the above object, the following aspects of the invention are provided.

A liquid ejection device according to a first aspect is a liquid ejection device including: a liquid ejection head having an ejecting surface on which ejection openings each for ejecting a liquid are formed, a maintenance unit for performing maintenance of the liquid ejection head, and a maintenance control unit for controlling an operation of the maintenance unit, in which the maintenance unit includes a first wiping unit that makes a first wiping member travel in a first direction to clean the ejecting surface, a second wiping unit that makes a second wiping member travel in a second direction which has a component of a direction opposite to the first direction to clean the ejecting surface, and a relative moving unit that moves the first wiping unit and the liquid ejection head relatively to each other and moves the second wiping unit and the liquid ejection head relatively to each other, and the maintenance control unit, in cleaning the ejecting surface by use of the first wiping unit, moves the first wiping unit and the liquid ejection head relatively to each other, using a direction having a component of the direction opposite to the first direction as a moving direction of the liquid ejection head with reference to the first wiping unit in the relative moving between the first wiping unit and the liquid ejection head by use of the relative moving unit, and, in cleaning the ejecting surface by use of the second wiping unit, moves the second wiping unit and liquid ejection head relatively to each other, using a direction having a component of a direction opposite to the second direction as a moving direction of the liquid ejection head with reference to the second wiping unit in the relative moving between the second wiping unit and the liquid ejection head by use of the relative moving unit, such that the first wiping unit and the second wiping unit are used to clean the same area on the ejecting surface.

According to the first aspect, the first wiping unit is used to clean the ejecting surface along the first direction, and the area cleaned by use of the first wiping unit is cleaned by use of the second wiping unit along the second direction which has the component opposite to the first direction, suppressing an un-wiped portion which is given biasedly to one side of the ejection opening formed on the ejecting surface.

Examples of an aspect of the liquid ejection device may include an inkjet recording apparatus provided with an inkjet head for ejecting the ink as a liquid ejection head.

The relative moving direction between the first wiping unit and the liquid ejection head may be a direction parallel with a traveling direction of the first wiping member or a direction crossing the traveling direction of the first wiping member. The relative moving direction between the second wiping unit and the liquid ejection head may be a direction parallel with a traveling direction of the second wiping member or a direction crossing the traveling direction of the second wiping member.

The traveling direction of the first wiping member may be parallel with or crossing the traveling direction of the second wiping member.

A second aspect may be configured such that, in the liquid ejection device according to the first aspect, the maintenance unit includes a purge unit that performs a purge treatment on the liquid ejection head, and the first wiping unit, the second wiping unit, and the purge unit are arranged in a relative moving direction of the relative moving unit in an order of the purge unit, the first wiping unit, and the second wiping unit.

According to the second aspect, the cleaning of the ejecting surface by use of the first wiping unit may be performed for the first time after performing the purge treatment on the liquid ejection head by use of the purge unit.

A cap unit may be included which is attached to the ejecting surface of the liquid ejection head and shared by the purge unit. In such an aspect, after the cap unit attached to the ejecting surface of the liquid ejection head is removed from the ejecting surface to release the capping, the first wiping unit and the second wiping unit may be used to perform the cleaning of the ejecting surface.

A third aspect may be configured such that, in the liquid ejection device according to the second aspect, the maintenance control unit performs the cleaning of the ejecting surface by use of the first wiping unit for the first time after the purge treatment is performed on the liquid ejection head by use of the purge unit, and performs the cleaning of the ejecting surface by use of the second wiping unit after the initial cleaning of the ejecting surface by use of the first wiping unit.

According to the third aspect, the cleaning of the ejecting surface by use of the first wiping unit is performed for the first time after the purge treatment is performed, suppressing dropping down of a residual liquid remaining on the ejecting surface or solidification of the residual liquid remaining on the ejecting surface.

A fourth aspect may be configured such that, in the liquid ejection device according to the second or third aspect, the maintenance unit includes a head retracting unit that retracts the liquid ejection head, and the head retracting unit, the first wiping unit, the second wiping unit, and the purge unit are arranged in the relative moving direction of the relative moving unit in an order of the head retracting unit, the second wiping unit, the first wiping unit, and the purge unit.

According to the fourth, the liquid ejection head can be moved to the head retracting unit after the cleaning of the ejecting surface by use of the first wiping unit.

A fifth aspect may be configured such that, in the liquid ejection device according to the fourth aspect, the maintenance control unit performs the cleaning of the ejecting surface by use of the first wiping unit for the first time after the purge treatment is performed on the liquid ejection head by use of the purge unit, and performs, after the initial cleaning of the ejecting surface by use of the first wiping unit, the cleaning of the ejecting surface by use of the second wiping unit after arranging the liquid ejection head in a position of the head retracting unit.

According to the fifth aspect, in cleaning the ejecting surface, it is not necessary to arrange the liquid ejection head in a liquid ejection unit.

The liquid ejection unit is arranged at a position where the liquid is ejected from the liquid ejection head toward a medium. Examples of an aspect of the liquid ejection unit may include an image drawing unit for performing image drawing on the medium.

A sixth aspect may be configured such that, in the liquid ejection device according to any one of the second to fifth aspects, assuming that $Q_1$ is a first cleaning time period absorption volume that is a liquid absorption volume of the first wiping member during a cleaning time period by use of the first wiping unit, and $Q_2$ is a second cleaning time period absorption volume that is a liquid absorption volume of the second wiping member during a cleaning time period by use of the second wiping unit, the first cleaning time period absorption volume $Q_1$ and the second cleaning time period absorption volume $Q_2$ satisfy a relationship of the next formula: $Q_1>Q_2$, and the maintenance control unit performs the cleaning of the ejecting surface by use of the first wiping unit for the first time after the purge treatment is performed on the liquid ejection head by use of the purge unit, and performs the cleaning of the ejecting surface by use of the second wiping unit after the initial cleaning of the ejecting surface by use of the first wiping unit.

According to the sixth aspect, the first wiping member which has relatively larger cleaning time period absorption volume is used to perform the cleaning of the ejecting surface for the first time after the purge treatment is performed, allowing the residual liquid on the ejecting surface to be ensured to be absorbed.

Additionally, after the initial cleaning by use of the first wiping member, the second wiping member which has relatively smaller cleaning time period absorption volume is used to perform the cleaning of the ejecting surface, so that the liquid extracted from the ejection opening is suppressed, which allows a meniscus to be stable and allows the liquid ejection after the cleaning of the ejecting surface to be stable.

A seventh aspect may be configured such that, in the liquid ejection device according to the sixth aspect, assuming that $V_{W1}$ is an absolute value of a traveling velocity of the first wiping member in an area where the first wiping member contacts with the ejecting surface, $V_{B1}$ is an absolute value of a relative velocity between the liquid ejection head and the first wiping member in the area where the first wiping member contacts with the ejecting surface, $A_1$ is a nip width that is a length of the first wiping member brought into contact with the ejecting surface in the traveling direction of the first wiping member in cleaning the ejecting surface by use of the first wiping unit, and $Q_{01}$ is an absorption volume of the first wiping member per unit length in the traveling direction of the first wiping member, the first cleaning time period absorption volume $Q_1$ is expressed by the next formula: $\{1+(V_{W1}/V_{B1})\}\times A_1\times Q_{01}$ and assuming that $V_{W2}$ is an absolute value of a traveling velocity of the second wiping member in an area where the second wiping member contacts with the ejecting surface, $V_{B2}$ is an absolute value of a relative velocity between the liquid ejection head and the second wiping member in the area where the second wiping member contacts with the ejecting surface, $A_2$ is a nip width that is a length of the second wiping member brought into contact with the ejecting surface in the traveling direction of the second wiping member in cleaning the ejecting surface by use of the second wiping unit, and $Q_{02}$ is an absorption volume of the second wiping member per unit length in the traveling direction of the second wiping member, the second cleaning time period absorption volume $Q_2$ is expressed by the next formula: $\{1+(V_{W2}/V_{B2})\}\times A_2\times Q_{02}$.

According to the seventh aspect, the first cleaning time period absorption volume $Q_1$ can be changed by varying at least any one of the absolute value $V_{W1}$ of the traveling velocity of the first wiping member in the area where the first wiping member contacts with the ejecting surface, the absolute value $V_{B1}$ of the relative velocity between the liquid ejection head and the first wiping member in the area where the first wiping member contacts with the ejecting surface, the nip width $A_1$ that is the length of the first wiping member in the traveling direction of the first wiping member, and the absorption volume $Q_{01}$ of the first wiping member per unit length in the traveling direction of the first wiping member.

Similarly, the second cleaning time period absorption volume $Q_2$ can be changed by varying at least any one of the absolute value $V_{W2}$ of the traveling velocity of the second wiping member in the area where the second wiping member contacts with the ejecting surface, the absolute value $V_{B2}$ of the relative velocity between the liquid ejection head and the second wiping member in the area where the second wiping member contacts with the ejecting surface, the nip width $A_2$ that is the length of the second wiping member in the traveling direction of the second wiping member, and the absorption volume $Q_{02}$ of the second wiping member per unit length in the traveling direction of the second wiping member.

An eighth aspect may be configured such that, in the liquid ejection device according to the sixth or seventh aspect, the maintenance unit includes a first cleaning liquid applying unit that applies a cleaning liquid to the first wiping member and a second cleaning liquid applying unit that applies the cleaning liquid to the second wiping member, and when the maintenance control unit uses the first cleaning liquid applying unit to apply the cleaning liquid to the first wiping member and uses the second cleaning liquid applying unit to apply the cleaning liquid to the second wiping member, assuming that $P_{1p}$ is a first cleaning liquid application amount that is a cleaning liquid application amount to the first wiping member in the cleaning of the ejecting surface by use of the first wiping unit for the first time after the purge treatment is performed by use of the purge unit, $P_{1n}$ is a second cleaning liquid application amount that is a cleaning liquid application amount to the first wiping member in the cleaning of the ejecting surface by use of the first wiping unit in a case of not performing the purge treatment by use of the purge unit, and $P_{2p}$ is a third cleaning liquid application amount that is a cleaning liquid application amount to the second wiping member in the cleaning of the ejecting surface by use of the second wiping unit in a case of performing the purge treatment by use of the purge unit, a relationship between the first cleaning liquid application amount $P_{1p}$, the second cleaning liquid application amount $P_{1n}$, and the third cleaning liquid application amount $P_{2p}$ satisfies a relationship expressed by the next formula: $0 \leq P_{1p} < P_{2p} \leq P_{1n}$.

According to the eighth aspect, the first cleaning liquid application amount $P_{1p}$ may be relatively small, which is the application amount of the cleaning liquid to the first wiping member in the case where the first wiping member is used for the cleaning of the ejecting surface for the first time after performing the purge treatment. The first cleaning liquid application amount $P_{1p}$ may be zero with no cleaning liquid being applied to the first wiping member.

The second cleaning liquid application amount $P_{1n}$ may be relatively small, which is the application amount of the cleaning liquid to the first wiping member in the case where the first wiping member is used for the cleaning of the ejecting surface in the case of not performing the purge treatment in order to suppress the liquid extracted from the ejection opening.

The third cleaning liquid application amount $P_{2p}$ may be relatively small, which is the application amount of the cleaning liquid to the second wiping member in a case where the second wiping member is used for the cleaning of the ejecting surface other than the cleaning of the ejecting surface for the first time after performing the purge treatment in order to suppress the liquid extracted from the ejection opening.

A ninth aspect may be configured such that, in the liquid ejection device according to the eighth aspect, when the maintenance control unit uses the first cleaning liquid applying unit to apply the cleaning liquid to the first wiping member and uses the second cleaning liquid applying unit to apply the cleaning liquid to the second wiping member, assuming that $P_{2n}$ is a fourth cleaning liquid application amount that is a cleaning liquid application amount to the second wiping member in the cleaning of the ejecting surface by use of the second wiping unit in the case of not performing the purge treatment by use of the purge unit, a relationship between the first cleaning liquid application amount $P_{1p}$, the second cleaning liquid application amount $P_{1n}$, and the fourth cleaning liquid application amount $P_{2n}$ satisfies a relationship expressed by the next formula: $0 \leq P_{1p} < P_{2n} \leq P_{1n}$.

According to the ninth aspect, the fourth cleaning liquid application amount $P_{2n}$ may be relatively small, which is the application amount of the cleaning liquid to the second wiping member in the case where the second wiping member is used for the cleaning of the ejecting surface in the case of not performing the purge treatment in order to suppress the liquid extracted from the ejection opening.

A cleaning method according to a tenth aspect is a cleaning method for cleaning a liquid ejection head having an ejecting surface on which ejection openings each for ejecting a liquid are formed, including a first wiping step of moving the liquid ejection head and a first wiping unit relatively to each other to clean the ejecting surface, the first wiping unit making a first wiping member travel in a first direction, a second wiping step of moving the liquid ejection head and a second wiping unit relatively to each other to clean the ejecting surface, the second wiping unit making a second wiping member travel in a second direction which has a component of a direction opposite to the first direction, in which in the first wiping step, the first wiping unit and the liquid ejection head are moved relatively to each other, using a direction having a component of the direction opposite to the first direction as a moving direction of the liquid ejection head with reference to the first wiping unit in the relative moving between the first wiping unit and the liquid ejection, in the second wiping step, the second wiping unit and liquid ejection head are moved relatively to each other, using a direction having a component of a direction opposite to the second direction as a moving direction of the liquid ejection head with reference to the second wiping unit in the relative moving between the second wiping unit and the liquid ejection head, and in the first wiping step and the second wiping step, the first wiping unit and the second wiping unit are used to clean the same area on the ejecting surface.

According to the tenth aspect, an action and effect the same as the first aspect can be obtained.

In the tenth aspect, matters similar to those specified in the second to ninth aspects can be appropriately combined. In this case, a component which performs the treatments and functions specified in the liquid ejection device may be grasped as a component of the cleaning method for performing treatments and functions corresponding to this.

An eleventh aspect may be configured such that the cleaning method according to the tenth aspect further includes a purging step of performing a purge treatment on the liquid ejection head, in which the first wiping step and the purging step are performed in an order of the first wiping step and the purging step in a case where the first wiping unit and the liquid ejection head are moved relatively to each other, using a direction having a component of a direction opposite to the first direction as a moving direction of the liquid ejection head with reference to the first wiping unit, and the second wiping step and the purging step are performed in an order of the purging step and the second wiping step in a case where the second wiping unit and the liquid ejection head are moved relatively to each other using a direction having a component of a direction opposite to the second direction as a moving direction of the liquid ejection head with reference to the second wiping unit.

According to the eleventh aspect, an action and effect the same as those of the second aspect can be obtained.

A twelfth aspect may be configured such that, in the cleaning method according to the eleventh aspect, assuming that $Q_1$ is a first cleaning time period absorption volume that is a liquid absorption volume of the first wiping member during a cleaning time period in the first wiping step, and $Q_2$ is a second cleaning time period absorption volume that is a liquid absorption volume of the second wiping member during a cleaning time period in the second wiping step, the first cleaning time period absorption volume $Q_1$ and the second cleaning time period absorption volume $Q_2$ satisfy a relationship of the next formula: $Q_1 \geq Q_2$, and after the purging step is performed, the first wiping step is firstly performed, and after the initial first wiping step, the second wiping step is performed.

According to the twelfth aspect, an action and effect the same as those of the sixth aspect can be obtained.

A thirteenth aspect may be configured such that, in the cleaning method according to the twelfth aspect, in the first wiping step, assuming that $V_{W1}$ is an absolute value of a traveling velocity of the first wiping member in an area where the first wiping member contacts with the ejecting surface, $V_{B1}$ is an absolute value of a relative velocity between the liquid ejection head and the first wiping member in the area where the first wiping member contacts with the ejecting surface, $A_1$ is a nip width that is a length of the first wiping member brought into contact with the ejecting surface in the traveling direction of the first wiping member in the first wiping step, and $Q_{01}$ is an absorption volume of the first wiping member per unit length in the traveling direction of the first wiping member, the first cleaning time period absorption volume $Q_1$ is expressed by the next formula: $\{1+(V_{W1}/V_{B1})\}\times A_1\times Q_{01}$ and in the second wiping step, assuming that $V_{W2}$ is an absolute value of a traveling velocity of the second wiping member in an area where the second wiping member contacts with the ejecting surface, $V_{B2}$ is an absolute value of a relative velocity between the liquid ejection head and the second wiping member in the area where the second wiping member contacts with the ejecting surface, $A_2$ is a nip width that is a length of the second wiping member brought into contact with the ejecting surface in the traveling direction of the second wiping member in the second wiping step, and $Q_{02}$ is an absorption volume of the second wiping member per unit length in the traveling direction of the second wiping member, the second cleaning time period absorption volume $Q_2$ is expressed by the next formula: $\{1+(V_{W2}/V_{B2})\}\times A_2\times Q_{02}$.

According to the thirteenth aspect, an action and effect the same as those of the seventh aspect can be obtained.

A fourteenth aspect may be configured such that the cleaning method according to the twelfth or thirteenth aspect further includes a cleaning liquid applying step of applying a cleaning liquid to the first wiping member and the second wiping member, in which in the cleaning liquid applying step, assuming that $P_{1p}$ is a first cleaning liquid application amount that is a cleaning liquid application amount to the first wiping member in the first wiping step for the first time after the purging step is performed, $P_{1n}$ is a second cleaning liquid application amount that is a cleaning liquid application amount to the first wiping member in the first wiping step in a case of not performing the purging step, and $P_{2p}$ is a third cleaning liquid application amount that is a cleaning liquid application amount to the second wiping member in the second wiping step in a case of performing the purging step, a relationship between the first cleaning liquid application amount $P_{1p}$, the second cleaning liquid application amount $P_{1n}$, and the third cleaning liquid application amount $P_{2p}$ satisfies a relationship expressed by the next formula: $0 \leq P_{1p} < P_{2p} \leq P_{1n}$.

According to the fourteenth aspect, an action and effect the same as those of the eighth aspect can be obtained.

A fifteenth aspect may be configured such that, in the cleaning method according to the fourteenth aspect, in the cleaning liquid applying step, in applying the cleaning liquid to the first wiping member and applying the cleaning liquid to the second wiping member, assuming that $P_{2n}$ is a fourth cleaning liquid application amount that is a cleaning liquid application amount to the second wiping member in the cleaning of the ejecting surface by use of the second wiping unit in a case of not performing the purging step, a relationship between the first cleaning liquid application amount $P_{1n}$, the second cleaning liquid application amount $P_{1n}$, and the fourth cleaning liquid application amount $P_{2n}$ satisfies a relationship expressed by the next formula: $0 \leq P_{1p} < P_{2n} \leq P_{1n}$.

According to the fifteenth aspect, an action and effect the same as those of the ninth aspect can be obtained.

According to the invention, the first wiping unit is used to clean the ejecting surface along the first direction, and the area cleaned by use of the first wiping unit is cleaned by use of the second wiping unit along the second direction that is a direction opposite to the first direction, suppressing an un-wiped portion which is given biasedly to one side of the ejection opening formed on the ejecting surface.

DETAILED DESCRIPTION OF THE EMBODIMENTS

Figure 1:
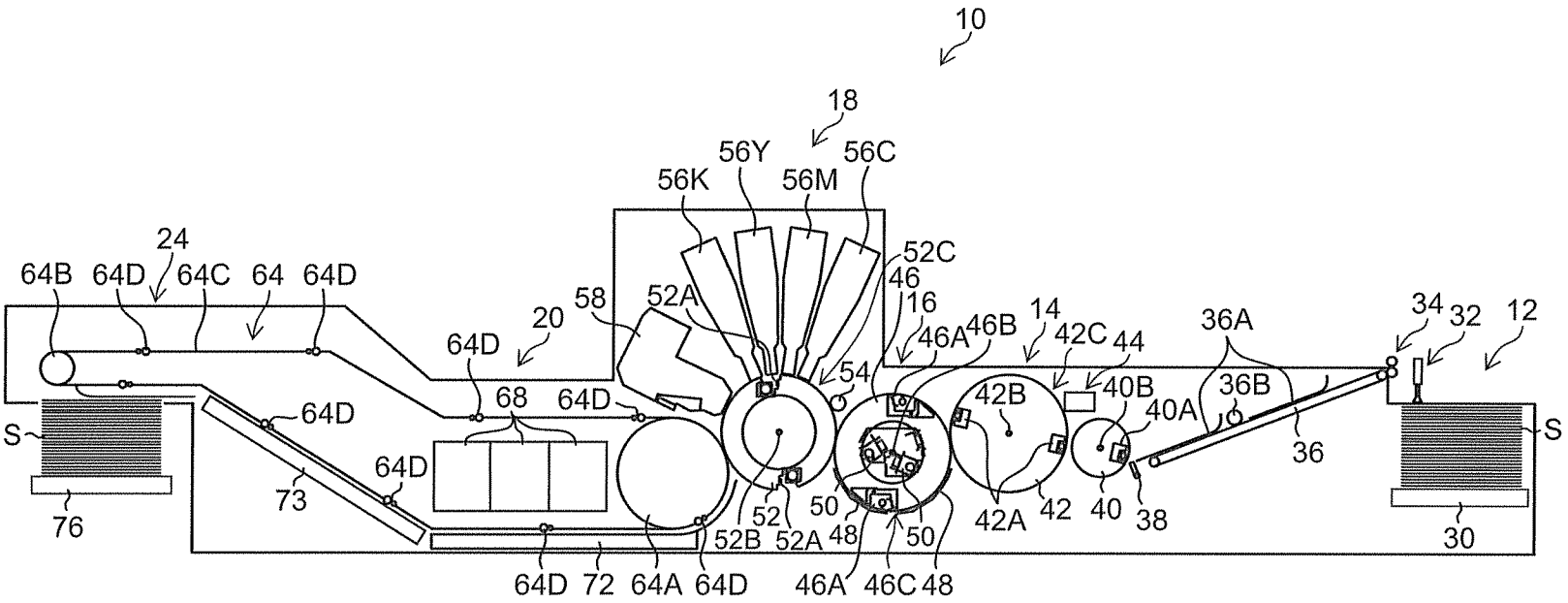
FIG. 1 is a general configuration diagram of an inkjet recording apparatus.

Hereinafter, a description is given of preferred embodiments of the present invention in detail with reference to the attached drawings. Herein, a component previously described is designated by the same reference numeral to appropriately omit the description thereon.

General Configuration of Liquid Ejection Device

First, a description is given of a general configuration of a liquid ejection device. This embodiment exemplifies an inkjet recording apparatus as a liquid ejection device. FIG. 1 is a general configuration diagram of the inkjet recording apparatus.

An inkjet recording apparatus 10 illustrated in FIG. 1 is an inkjet recording apparatus for drawing an image by means of inkjet printing using an ink on a paper sheet S as a cut sheet.

The term "ink" used herein may be appropriately replaced with a term "liquid". The paper sheet S is an aspect of a medium.

The inkjet recording apparatus 10 includes a paper feed unit 12, a treatment liquid applying unit 14, a treatment liquid drying treatment section 16, an image drawing unit 18, an ink drying treatment section 20, and a paper output unit 24. Hereinafter, the units and the sections are described in detail.

<Paper Feed Unit>

The paper feed unit 12 includes a paper feed platform 30, a sucker device 32, a paper feed roller pair 34, a feeder board 36, a front stop 38, and a paper feed drum 40. The feeder board 36 includes a retainer 36A and a guide roller 36B.

The retainer 36A and the guide roller 36B are arranged on a conveying surface of the feeder board 36 by which the paper sheet S is conveyed. The front stop 38 is arranged between the feeder board 36 and the paper feed drum 40.

The paper feed drum 40 has a cylindrical shape with its longitudinal direction being a direction in parallel to a rotary shaft 40B. The paper feed drum 40 has a length in the longitudinal direction exceeding an entire length of the paper sheet S. A direction of the rotary shaft 40B of the paper feed drum 40 is a direction penetrating a paper plane of FIG. 1.

The paper feed drum 40 illustrated in FIG. 1 is an aspect of a conveying drum for conveying the medium. The drum is a conveying member which has a cylindrical shape and rotates about a central axis of the cylindrical shape while holding at least a part of the medium to convey the medium along an outer circumferential surface of the cylindrical shape.

Here, the term "parallel" used herein inclusively means a state of being substantially parallel exerting an action and effect the same as being parallel even where two directions intersects.

The term "perpendicular" used herein inclusively means, of a case of intersecting at an angle more than 90 degrees and a case of intersecting at an angle less than 90 degrees, a state being substantially perpendicular exerting an action and effect the same as that in a case of intersecting at an angle of 90 degrees.

The term "the same" used herein inclusively means a state of being substantially the same capable of obtaining an action and effect similar to "the same" even where a targeted configuration has a difference.

The paper feed drum 40 includes a gripper 40A. The gripper 40A includes a plurality of claws, a claw mount, and a gripper shaft. The plural claws, the claw mount, and the gripper shaft are not illustrated in the figure.

The plural claws of the gripper 40A are arranged along a direction parallel with the rotary shaft 40B of the paper feed drum 40. Base ends of the plural claws are swingably supported by the gripper shaft. Arrangement intervals of the plural claws and a length of an area where the plural claws are arranged are defined depending on a size of the paper sheet S.

The claw mount is a member whose longitudinal direction is a direction parallel with the rotary shaft 40B of the paper feed drum 40. A length of the claw mount in the longitudinal direction of the paper feed drum 40 is equal to or more than the length of the area where the plural claws are arranged. The claw mount is arranged at a position facing tip ends of the plural claws.

The paper feed unit 12 feeds the paper sheet S stacked on the paper feed platform 30 one by one to the treatment liquid applying unit 14. The paper sheets S stacked on the paper feed platform 30 are sequentially lifted from the top thereof one by one by a sucker device 32 and fed to the paper feed roller pair 34.

The paper sheet S fed to the paper feed roller pair 34 is placed on the feeder board 36 and conveyed by the feeder board 36. The paper sheet S conveyed by the feeder board 36 is pressed against the conveying surface of the feeder board 36 by the retainer 36A and the guide roller 36B to correct irregularity.

The paper sheet S conveyed by the feeder board 36 abuts on the front stop 38 at a leading end thereof to be corrected in inclination. The paper sheet S conveyed by the feeder board 36 is transferred to the paper feed drum 40.

The paper sheet S transferred to the paper feed drum 40 is gripped at a leading end portion thereof by the gripper 40A of the paper feed drum 40. When the paper feed drum 40 is rotated, the paper sheet S is conveyed along an outer circumferential surface of the paper feed drum 40. The paper sheet S conveyed by the paper feed drum 40 is transferred to the treatment liquid applying unit 14.

<Treatment Liquid Applying Unit>

The treatment liquid applying unit 14 includes a treatment liquid drum 42 and a treatment liquid applying device 44. The treatment liquid drum 42 includes grippers 42A. To the gripper 42A, the same configuration as the gripper 40A of the paper feed drum 40 may be applied.

The treatment liquid drum 42 illustrated in FIG. 1 has a diameter twice that of the paper feed drum 40. The treatment liquid drum 42 has the grippers 42A arranged at two positions. Two arranged positions for the grippers 42A are positions shifted from each other by half of a perimeter on an outer circumferential surface 42C of the treatment liquid drum 42.

The treatment liquid drum 42 has a configuration to fix the paper sheet S to the outer circumferential surface 42C where the paper sheet S is supported. Examples of the configuration to fix the paper sheet S to the outer circumferential surface 42C of the treatment liquid drum 42 may include those where a plurality of suction holes are provided to the outer circumferential surface 42C of the treatment liquid drum 42 and a negative pressure is exerted on the plural suction holes.

To the treatment liquid drum 42, the same configuration as the paper feed drum 40 may be applied except for the above. Reference numeral and character 42B designates a rotary shaft of the treatment liquid drum 42.

The treatment liquid applying device 44 may adopt roller coating. As the roller coating treatment liquid applying device 44, a configuration may be used which includes a treatment liquid bath, a measuring roller, and a coating roller.

The treatment liquid bath reserves therein the treatment liquid supplied from a treatment liquid tank via a treatment liquid supply system. The measuring roller measures the treatment liquid reserved in the treatment liquid bath. The measuring roller transfers the measured treatment liquid to the coating roller. The coating roller coats the paper sheet S with the treatment liquid.

The configuration of the treatment liquid applying device 44 described here is merely an example and another scheme may be applied to the treatment liquid applying device 44. In addition, another configuration may be applied to the treatment liquid applying device 44.

Examples of another scheme for the treatment liquid applying device 44 may include coating by means of blading, ejecting by means of inkjet, or atomizing by means of spraying.

When the treatment liquid drum 42 is rotated in a state where the leading end of the paper sheet S is gripped by the gripper 42A, the paper sheet S is conveyed along the outer circumferential surface of the treatment liquid drum 42. The paper sheet S conveyed along the outer circumferential surface of the treatment liquid drum 42 is given the treatment liquid by the treatment liquid applying device 44. The paper sheet S given the treatment liquid is sent to the treatment liquid drying treatment section 16.

The treatment liquid given to the paper sheet S has a function to aggregate a coloring material in an ink which is deposited on the paper sheet S by the image drawing unit 18 at a later stage or to insolubilize the coloring material in the ink. By depositing the ink on the paper sheet S given the treatment liquid, high quality of image forming is enabled with no landing interference occurring even if a general-purpose paper sheet is used.

The term "ejection" used herein be appropriately read as droplet deposition or image forming.

The paper sheet S given the treatment liquid by the treatment liquid applying unit 14 is transferred to the treatment liquid drying treatment section 16.

<Treatment Liquid Drying Treatment Section>

The treatment liquid drying treatment section 16 includes a treatment liquid drying treatment drum 46, a paper sheet conveyance guide 48, and a treatment liquid drying treatment unit 50. The treatment liquid drying treatment drum 46 includes grippers 46A. To the gripper 46A, the same configuration as the gripper 40A of the paper feed drum 40 may be applied.

The treatment liquid drying treatment drum 46 illustrated in FIG. 1 has a diameter twice that of the paper feed drum 40. The treatment liquid drying treatment drum 46 has the grippers 46A arranged at two positions. Two arranged positions for the grippers 46A are positions shifted from each other by half of a perimeter on an outer circumferential surface 46C of the treatment liquid drying treatment drum 46.

To the configuration of the treatment liquid drying treatment drum 46 except for the above, the same configuration as the paper feed drum 40 may be applied. Reference numeral and character 46B designates a rotary shaft of the treatment liquid drying treatment drum 46.

The paper sheet conveyance guide 48 is arranged at a position facing the outer circumferential surface 46C of the treatment liquid drying treatment drum 46. The paper sheet conveyance guide 48 is arranged on a lower side of the treatment liquid drying treatment drum 46.

The lower side used herein is a side toward a direction of gravitational force. An upper side is a side opposite to the direction of gravitational force.

The treatment liquid drying treatment unit 50 is arranged in the inside of the treatment liquid drying treatment drum 46. The treatment liquid drying treatment unit 50 includes a blower unit for blowing an air toward an outside of the treatment liquid drying treatment drum 46 and a heating unit for heating the air. For the convenience of illustration, reference numerals of the blower unit and the heating unit are omitted.

The paper sheet S transferred from the treatment liquid applying unit 14 to the treatment liquid drying treatment section 16 is gripped at the leading end thereof by the grippers 46A of the treatment liquid drying treatment drum 46.

The paper sheet S is supported, in a state where its surface given the treatment liquid faces the outer circumferential surface 46C of the treatment liquid drying treatment drum 46, at a surface on an opposite side of the surface given the treatment liquid by the paper sheet conveyance guide 48. By rotating the treatment liquid drying treatment drum 46, the paper sheet S is conveyed along the outer circumferential surface 46C of the treatment liquid drying treatment drum 46.

The paper sheet S which is conveyed by the treatment liquid drying treatment drum 46 and supported by the paper sheet conveyance guide 48 is blown with a heated air from the treatment liquid drying treatment unit 50 to be subjected to a drying treatment.

When the paper sheet S is subjected to the drying treatment, a solvent component in the treatment liquid given to the paper sheet S is removed and a treatment liquid layer is formed on the surface of the paper sheet S given the treatment liquid. The paper sheet S subjected to the drying treatment by the treatment liquid drying treatment section 16 is transferred to the image drawing unit 18.

<Image Drawing Unit>

The image drawing unit 18 includes an image drawing drum 52, a paper sheet pressing roller 54, a liquid ejection head 56C, a liquid ejection head 56M, a liquid ejection head 56Y, a liquid ejection head 56K, and an inline sensor 58. The image drawing drum 52 includes grippers 52A.

The gripper 52A is arranged in a concave portion provided on an outer circumferential surface 52C of the image drawing drum 52. The same configuration as the gripper 40A of the paper feed drum 40 can be applied, except for the configuration of the gripper 52A arrangement.

The image drawing drum 52 has the grippers 52A arranged at two positions similarly to the treatment liquid drying treatment drum 46. To the gripper 52A arrangement at two positions, the same arrangement as the treatment liquid drying treatment drum 46 can be applied.

The image drawing drum 52 has suction holes arranged on the outer circumferential surface 52C where paper sheet S is supported. The suction holes are arranged in a medium supported area where the paper sheet S is supported by suction. The suction holes and the medium supported area are not illustrated in the figure.

To the configuration of the image drawing drum 52 except for the above, the same configuration as the paper feed drum 40 can be applied. Reference numeral and character 52B designates a rotary shaft of the image drawing drum 52.

The paper sheet pressing roller 54 has a cylindrical shape. A longitudinal direction of the paper sheet pressing roller 54 is a direction parallel with the rotary shaft 52B of the image drawing drum 52. The paper sheet pressing roller 54 has a length in the longitudinal direction exceeding an entire length of the paper sheet S.

The paper sheet pressing roller 54 is arranged, in a conveying direction of the paper sheet S in the image drawing drum 52, on a downstream side of a position where the paper sheet S is transferred and on an upstream side of the liquid ejection head 56C. In the following description, the conveying direction of the paper sheet S may be described as a paper sheet conveying direction. The paper sheet conveying direction corresponds to a medium conveying direction.

The liquid ejection head 56C, the liquid ejection head 56M, the liquid ejection head 56Y, and the liquid ejection head 56K include ejection elements for ejecting the liquid by means of inkjet. The ejection element includes nozzle openings. The ejection element may include a flow channel communicating with the nozzle openings and a structure for generating an ejection pressure. The inkjet printing liquid ejection head includes those called an inkjet head. The nozzle opening corresponds to an ejection opening.

Here, an alphabetical character suffixed to the reference numeral of the liquid ejection head designates a color. The character C represents cyan. The character M represent magenta. The character Y represents yellow. The character K represents black.

The liquid ejection head 56C, the liquid ejection head 56M, the liquid ejection head 56Y, and the liquid ejection head 56K are arranged on the upper side of the image drawing drum 52. The liquid ejection head 56C, the liquid ejection head 56M, the liquid ejection head 56Y, and the liquid ejection head 56K are arranged along the paper sheet conveying direction in an order of the liquid ejection head 56C, the liquid ejection head 56M, the liquid ejection head 56Y, and the liquid ejection head 56K from the paper sheet conveying direction upstream side.

The inline sensor 58 is arranged on the downstream side of the liquid ejection head 56K in the paper sheet conveying direction. The inline sensor 58 includes an image pickup device, peripheral circuits for the image pickup device, and a light source.

To the image pickup device, a solid-state image sensing device such as a CCD image sensor and a CMOS image sensor can be applied. The image pickup device, the peripheral circuits for the image pickup device, and the light source are not illustrated in the figure. The CCD is an abbreviated word of Charge Coupled Device. The CMOS is an abbreviated word of Complementary Metal-Oxide Semiconductor.

The peripheral circuits for the image pickup device includes a processing circuit for an output signal of the image pickup device. Examples of the processing circuit may include a filter circuit for removing a noise component from the output signal of the image pickup device, an amplifier circuit, or a waveform shaping circuit. The filter circuit, the amplifier circuit, or the waveform shaping circuit are not illustrated in the figure.

The light source is arranged at a position capable of emitting an illuminating light to an object to be read by the inline sensor. To the light source, an LED or a lamp may be applied. The LED is an abbreviated word of light emitting diode.

The paper sheet S transferred from the treatment liquid drying treatment section 16 to the image drawing unit 18 is gripped at the leading end thereof by the grippers 52A of the image drawing drum 52. The paper sheet S whose leading end is gripped by the grippers 52A of the image drawing drum 52 is conveyed along the outer circumferential surface 52C of the image drawing drum 52 by way of the rotation of the image drawing drum 52.

The paper sheet S, in passing under the paper sheet pressing roller 54, is pressed against the outer circumferential surface 52C of the image drawing drum 52. On the paper sheet S having passed under the paper sheet pressing roller 54, an imaged is formed by the color inks respectively ejected from the liquid ejection head 56C, the liquid ejection head 56M, the liquid ejection head 56Y, and the liquid ejection head 56K, when the paper sheet S is immediately under the liquid ejection head 56C, the liquid ejection head 56M, the liquid ejection head 56Y, and the liquid ejection head 56K.

The paper sheet S on which the image has been formed by the liquid ejection head 56C, the liquid ejection head 56M, the liquid ejection head 56Y, and the liquid ejection head 56K is read by the inline sensor 58, in a reading area of the inline sensor 58.

The paper sheet S on which the image has been read by the inline sensor 58 is transferred from the image drawing unit 18 to the ink drying treatment section 20. Whether or not ejection abnormality is occurring may be determined based on a result of reading the image by the inline sensor 58.

<Ink Drying Treatment Section>

The ink drying treatment section 20 includes a chain gripper 64, an ink drying treatment unit 68, and a guide plate 72. The chain gripper 64 includes a first sprocket 64A, a second sprocket 64B, a chain 64C, and a plurality of grippers 64D.

The chain gripper 64 has a structure in which a pair of endless chains 64C is wound around a pair of the first sprocket 64A and a pair of the second sprocket 64B. FIG. 1 illustrates only one of the pair of the first sprockets 64A, only one of the pair of the second sprockets 64B, and only one of the pair of the chains 64C.

The chain gripper 64 has a structure in which the plural grippers 64D are arranged between the pair of the chains 64C. The chain gripper 64 has a structure in which the plural grippers 64D are arranged at a plurality of positions in the paper sheet conveying direction. FIG. 1 illustrates only one gripper 64D of the plural grippers 64D arranged between the pair of the chains 64C.

The chain gripper 64 illustrated in FIG. 1 includes a horizontal conveying area in which the paper sheet S is conveyed along a horizontal direction and an inclined conveying area in which the paper sheet S is conveyed in an obliquely upward direction.

The ink drying treatment unit 68 is arranged on a conveying path of the paper sheet S in the chain gripper 64. Examples of a configuration of the ink drying treatment unit 68 include those having a heat source such as a halogen heater and an infrared heat. Other examples of the configuration of the ink drying treatment unit 68 include those having a fan for blowing an air heated by a head source to the paper sheet S. The ink drying treatment unit 68 may be configured to include a head source and a fan.

A detailed illustration of the guide plate 72 is not illustrated in the figure, but a plate-like member may be used to the guide plate 72. The guide plate 72 has a length exceeding the entire length of the paper sheet S in a direction perpendicular to the paper sheet conveying direction.

The guide plate 72 is arranged along the conveying path in the horizontal conveying area for the paper sheet S by means of the chain gripper 64. The guide plate 72 is arranged on an under side of the conveying path for the paper sheet S by means of the chain gripper 64. The guide plate 72 has a length in the paper sheet conveying direction corresponding to a length of a treatment area for the ink drying treatment unit 68.

The length corresponding to the length of the treatment area for the ink drying treatment unit 68 is the length of the guide plate 72 capable of supporting the paper sheet S by the guide plate 72 in the treatment by the ink drying treatment unit 68.

For example, there may be an aspect in which the length of the treatment area for the ink drying treatment unit 68 is made equal to the length of the guide plate 72 in the paper sheet conveying direction. The guide plate 72 may have a function to support the paper sheet S by suction.

The paper sheet S transferred from the image drawing unit 18 to the ink drying treatment section 20 is gripped at the leading end thereof by the grippers 64D. When at least one of the first sprocket 64A and the second sprocket 64B is rotated in a clockwise direction in FIG. 1 to make the chain 64C travel, the paper sheet S is conveyed along a traveling path of the chain 64C.

When the paper sheet S passes through the treatment area for the ink drying treatment unit 68, the paper sheet S is subjected to ink drying treatment by the ink drying treatment unit 68.

The paper sheet S having been subjected to the ink drying treatment by the ink drying treatment unit 68 is conveyed by the chain gripper 64 and sent to the paper output unit 24.

The chain gripper 64 illustrated in FIG. 1 conveys the paper sheet S in a left obliquely upward direction in FIG. 1 on the downstream side of the ink drying treatment unit 68 in the paper sheet conveying direction. A guide plate 73 is arranged on the conveying path in the inclined conveying area in which the paper sheet S is conveyed in the left obliquely upward direction in FIG. 1.

To the guide plate 73, the same member as the guide plate 72 can be applied. A description of a structure and function of the guide plate 73 is omitted.

<Paper Output Unit>

The paper output unit 24 includes a paper output platform 76. To the conveyance of the paper sheet S in the paper output unit 24, the chain gripper 64 is applied.

The paper output platform 76 is arranged on the lower side of the conveying path for the paper sheet S by means of the chain gripper 64. The paper output platform 76 may be configured to include a lifting and lowering mechanism not illustrated in the figure. The paper output platform 76 may be lifted or lowered depending on increase and decrease of the paper sheets S stacked to keep constant a height of the paper sheet S placed on the top of the stack.

The paper output unit 24 collects the paper sheets S having been subjected to a series of the treatments for image formation. When the paper sheet S reaches a position of the paper output platform 76, the gripper 64D releases the paper sheet S. The paper sheet S is stacked on the paper output platform 76.

FIG. 1 illustrates the inkjet recording apparatus 10 including the treatment liquid applying unit 14 and the treatment liquid drying treatment section 16, but an aspect may also be applied in which the treatment liquid applying unit 14 and the treatment liquid drying treatment section 16 are omitted.

In addition, FIG. 1 exemplifies the chain gripper 64 as the configuration for conveying the paper sheet S after the image drawing, but to the configuration for conveying the paper sheet S after the image drawing, another configuration may be applied such as belt conveyance or conveying drum conveyance.

Figure 2:
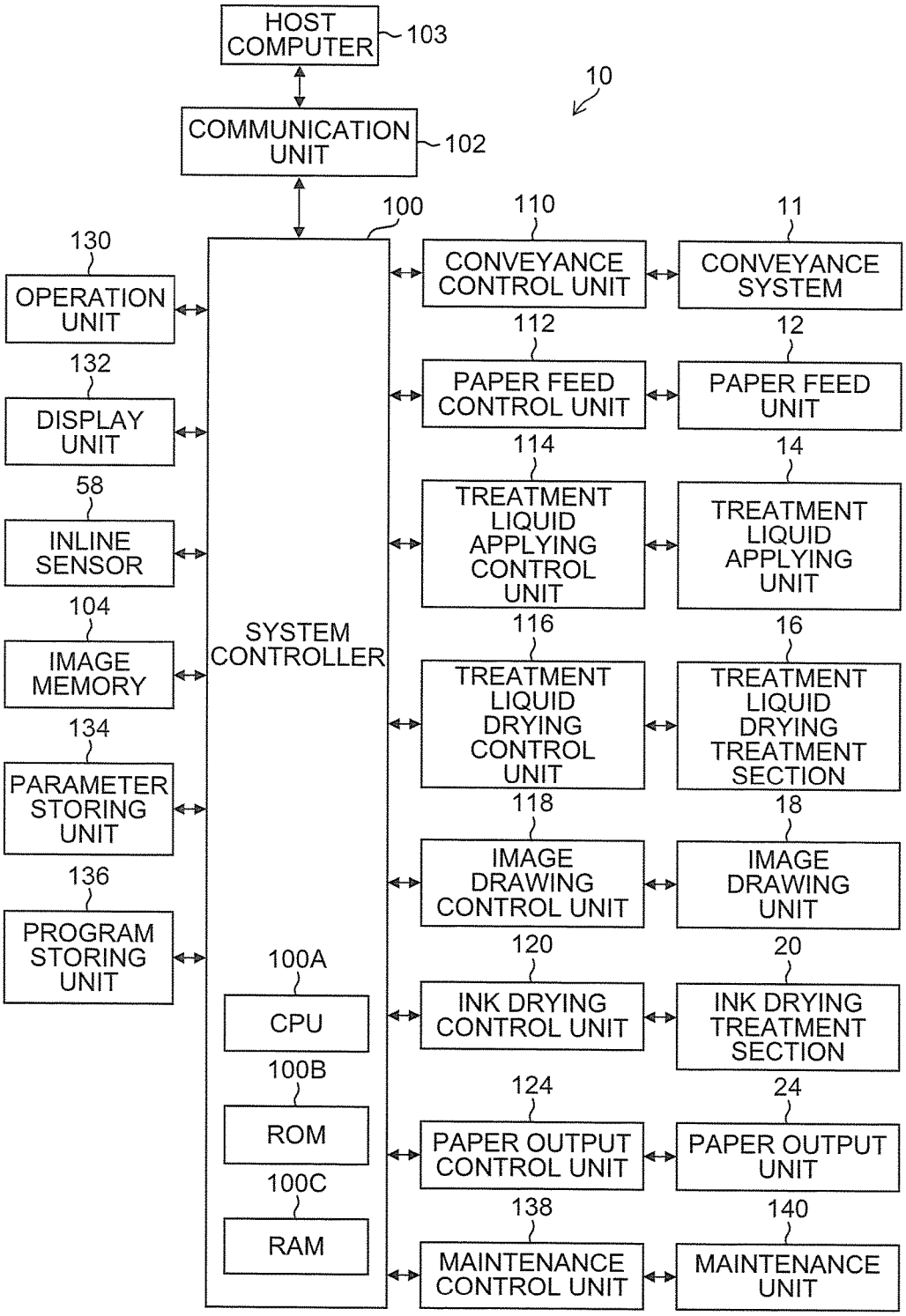
FIG. 2 is a block diagram illustrating a schematic configuration of a controlling system.

The inkjet recording apparatus 10 includes a maintenance unit, but not illustrated in FIG. 1. The maintenance unit is illustrated in FIG. 2 and designated by reference numeral 140. A description of the maintenance unit is made in detail later.

Explanation of Controlling System

FIG. 2 is a block diagram illustrating a schematic configuration of a controlling system. The inkjet recording apparatus 10 includes a system controller 100 as illustrated in FIG. 2. The system controller 100 includes a CPU 100A, a ROM 100B, and a RAM 100C.

The ROM 100B and the RAM 100C illustrated in FIG. 2 may be provided outside the CPU. The CPU is an abbreviated word of Central Processing Unit. The ROM is an abbreviated word of Read Only Memory. The RAM is an abbreviated word of Random Access Memory.

The system controller 100 functions as a general control unit for generally controlling the units and sections in the inkjet recording apparatus 10. The system controller 100 also functions as a calculating unit for performing various calculation processes.

Further, the system controller 100 functions as a memory controller for controlling data reading and data writing with respect to a memory such as the ROM 100B and the RAM 100C.

The inkjet recording apparatus 10 includes a communication unit 102, an image memory 104, a conveyance control unit 110, a paper feed control unit 112, a treatment liquid applying control unit 114, a treatment liquid drying control unit 116, an image drawing control unit 118, an ink drying control unit 120, and a paper output control unit 124.

The communication unit 102 includes a communication interface not illustrated in the figure. The communication unit 102 can transmit and receive data to and from a host computer 300 connected with the communication interface.

The image memory 104 functions as a transitory storage device for various pieces of data including image data. The data is read and written from and into the image memory 104 via the system controller 100. The image data taken in via the communication unit 102 from the host computer 103 is stored once in the image memory 104.

The conveyance control unit 110 controls an operation of a conveyance system 11 for the paper sheet S in the inkjet recording apparatus 10. The conveyance system 11 illustrated in FIG. 2 includes the treatment liquid drum 42, the treatment liquid drying treatment drum 46, the image drawing drum 52, and the chain gripper 64, which are illustrated in FIG. 1.

The paper feed control unit 112 illustrated in FIG. 2 controls, in response to an instruction from the system controller 100, the paper feed unit 12 to operate. The paper feed control unit 112 controls an operation for starting supply of the paper sheet S and an operation for ending supply of the paper sheet S.

The treatment liquid applying control unit 114 controls, in response to an instruction from the system controller 100, the treatment liquid applying unit 14 to operate. The treatment liquid applying control unit 114 controls an application amount of the treatment liquid, an application timing and the like.

The treatment liquid drying control unit 116 controls, in response to an instruction from the system controller 100, the treatment liquid drying treatment section 16 to operate. The treatment liquid drying control unit 116 controls a drying temperature, a flow rate of a dried gas, an injection timing of the dried gas and the like.

The image drawing control unit 118 controls, in response to an instruction from the system controller 100, an operation of the image drawing unit 18.

The image drawing control unit 118 includes an image processing unit, a waveform generating unit, a waveform storing unit, and a drive circuit. The image processing unit, the waveform generating unit, the waveform storing unit, and the drive circuit are not illustrated in the figure.

The image processing unit forms dot data from the input image data. The waveform generating unit generates a waveform of a drive voltage. The waveform storing unit stores therein the waveform of the drive voltage. The drive circuit generates a drive voltage having a drive waveform depending on the dot data. The drive circuit supplies the drive voltage to the liquid ejection head.

The image processing unit subjects the input image data to a color separation process of separating into each color of RGB, a color conversion process of converting RGB into CMYK, a correction process such as gamma correction and unevenness correction, and a half-tone process of converting a tone value for each pixel of each color into a tone value less than an original tone value.

As one example of the input image data, raster data may be used which is represented by a digital value from 0 to 255. The dot data obtained as a result of the half-tone process may be binary data, or ternary or more multivalued data less than the tone value before the half-tone process.

An ejection timing and ink ejection amount at each pixel position are determined on the basis of the dot data generated through the process by the image processing unit, the drive voltage and a control signal determining the ejection timing for each pixel are generated depending on the ejection timing and ink ejection amount at each pixel position, this drive voltage is supplied to the liquid ejection head, and a dot is recorded by the ink ejected from the liquid ejection head.

The image drawing control unit 118 may include a correction processing unit not illustrated in the figure. The correction processing unit subjects an abnormal nozzle to a correction process. When the correction process is performed, image quality deterioration caused by occurrence of the abnormal nozzle is suppressed.

The ink drying control unit 120 controls, in response to an instruction from the system controller 100, the ink drying treatment section 20 to operate. The ink drying control unit 120 controls a dried gas temperature, a flow rate of the dried gas, an injection timing of the dried gas or the like.

The paper output control unit 124 controls, in response to an instruction from the system controller 100, the paper output unit 24 to operate. In a case where the paper output platform 76 illustrated in FIG. 1 includes a lifting and lowering mechanism, the paper output control unit 124 controls an operation of the lifting and lowering mechanism depending on increase and decrease of the paper sheet S.

The inkjet recording apparatus 10 illustrated in FIG. 2 includes an operation unit 130, a display unit 132, a parameter storing unit 134, and a program storing unit 136.

The operation unit 130 includes an operation member such as an operation button, a keyboard, or a touch panel. The operation unit 130 may include a plurality of kinds of operation members. The operation members are not illustrated in the figure.

Information input via the operation unit 130 is sent to the system controller 100. The system controller 100 performs various processes in response to the information sent from the operation unit 130.

The display unit 132 includes a display device such as a liquid crystal panel, and a display driver. The display device and the display driver are not illustrated in the figure. The display unit 132 displays on the display device, in response to an instruction from the system controller 100, various pieces of information such as various pieces of setting information concerning the devices and abnormality information.

The parameter storing unit 134 stores therein various parameters used by the inkjet recording apparatus 10. The various parameters stored in the parameter storing unit 134 are read out via the system controller 100 to be set for the units and sections in the device 10.

The program storing unit 136 stores therein programs used by the units and sections in the inkjet recording apparatus 10. The various programs stored in the program storing unit 136 are read out via the system controller 100 to be executed in the units and sections in the device 10.

The inkjet recording apparatus 10 illustrated in FIG. 2 includes a maintenance control unit 138. The maintenance control unit 138 controls, in response to an instruction from the system controller 100, an operation of the maintenance unit 140.

The operation of the maintenance unit 140 illustrated in the embodiment may include wiping of the ejecting surface of the liquid ejection head. The operation of the maintenance unit 140 may include a purge treatment for the liquid ejection head.

The maintenance control unit 138 illustrated in FIG. 2 may include a wiping control unit for controlling an operation of the wiping unit which wipes the ejecting surface of the liquid ejection head. The maintenance control unit 138 illustrated in FIG. 2 may include a purge control unit for controlling the purge treatment for the liquid ejection head.

FIG. 2 lists the units and sections for each function. The units and sections illustrated in FIG. 2 may be appropriately integrated, separated, shared, or omitted. The units and sections illustrated in FIG. 2 may be configured by appropriately combining hardware and software.

Structure of Liquid Ejection Head

Next, a description is given of a structure of the liquid ejection head illustrated in FIG. 1.

<General Structure>

Figure 3:
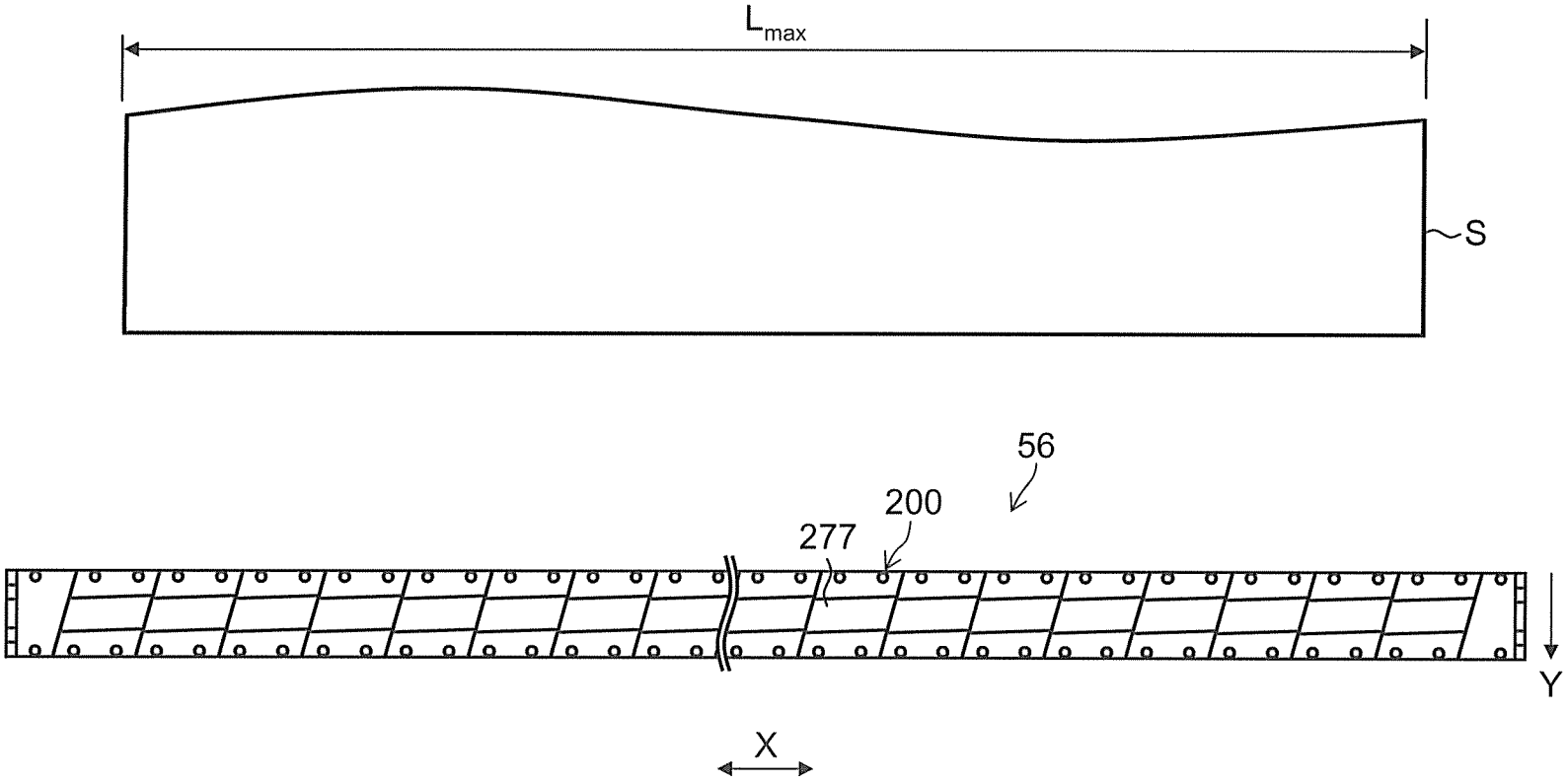
FIG. 3 is a perspective plan view illustrating an exemplary structure of a liquid ejection head.

FIG. 3 is a perspective plan view illustrating an exemplary structure of the liquid ejection head. The same structure may be applied to the liquid ejection head 56C for ejecting a cyan ink, the liquid ejection head 56M for ejecting a magenta ink, the liquid ejection head 56Y for ejecting a yellow ink, and the liquid ejection head 56K for ejecting a black ink, which are illustrated in FIG. 1.

When it is not necessary to distinguish the liquid ejection head 56C, the liquid ejection head 56M, the liquid ejection head 56Y, and the liquid ejection head 56K, reference numeral 56 is used to represent the liquid ejection head.

Figure 6:
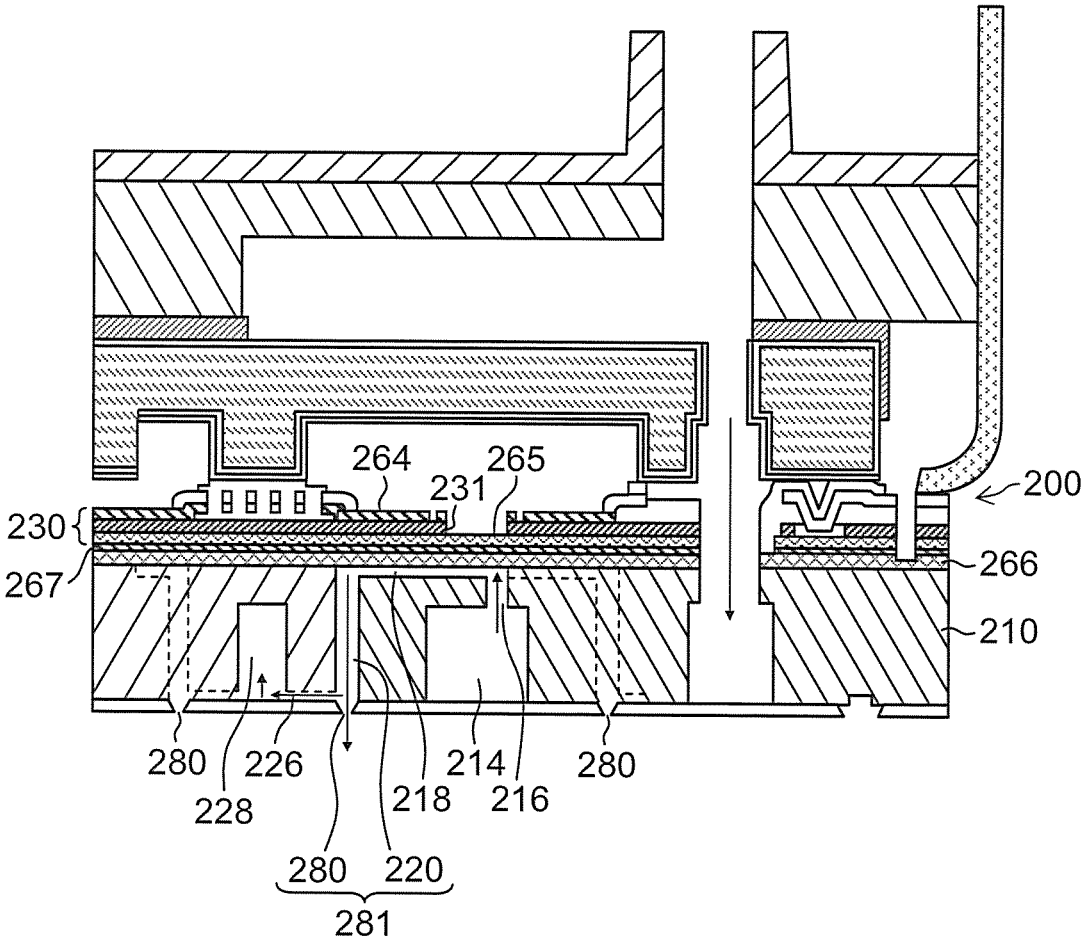
FIG. 6 is a cross-sectional view illustrating an internal structure of the head module.

As illustrated in FIG. 3, the liquid ejection head 56 is a line type head. The line type head has a structure in which a plurality of nozzle units are arranged in a direction perpendicular to the paper sheet conveying direction across a length exceeding an entire width $L_{max}$ of the paper sheet S. The nozzle units are not illustrated in FIG. 3. The nozzle unit is illustrated in FIG. 6 and designated by reference numeral 281.

A direction designated by reference character X illustrated in FIG. 3 is a direction perpendicular to the paper sheet conveying direction. A direction designated by reference character Y illustrated in FIG. 3 is the paper sheet conveying direction.

Hereinafter, a direction perpendicular to the paper sheet conveying direction may be represented as a paper sheet width direction or an X direction. The paper sheet conveying direction may be represented as a Y direction.

The liquid ejection head 56 illustrated in FIG. 3 includes a plurality of head modules 200. The plural head modules 200 are arranged to be aligned along the paper sheet width direction.

The same configuration may be applied to the plural head modules 200. The head module 200 may has a structure capable of functioning as the liquid ejection head in a single module.

FIG. 3 illustrates the liquid ejection head 56 having the plural head modules 200 arranged to be aligned along the paper sheet width direction, but the plural head modules 200 may be arranged in two lines which are shifted from each other in their phases in the paper sheet conveying direction.

Figure 5:
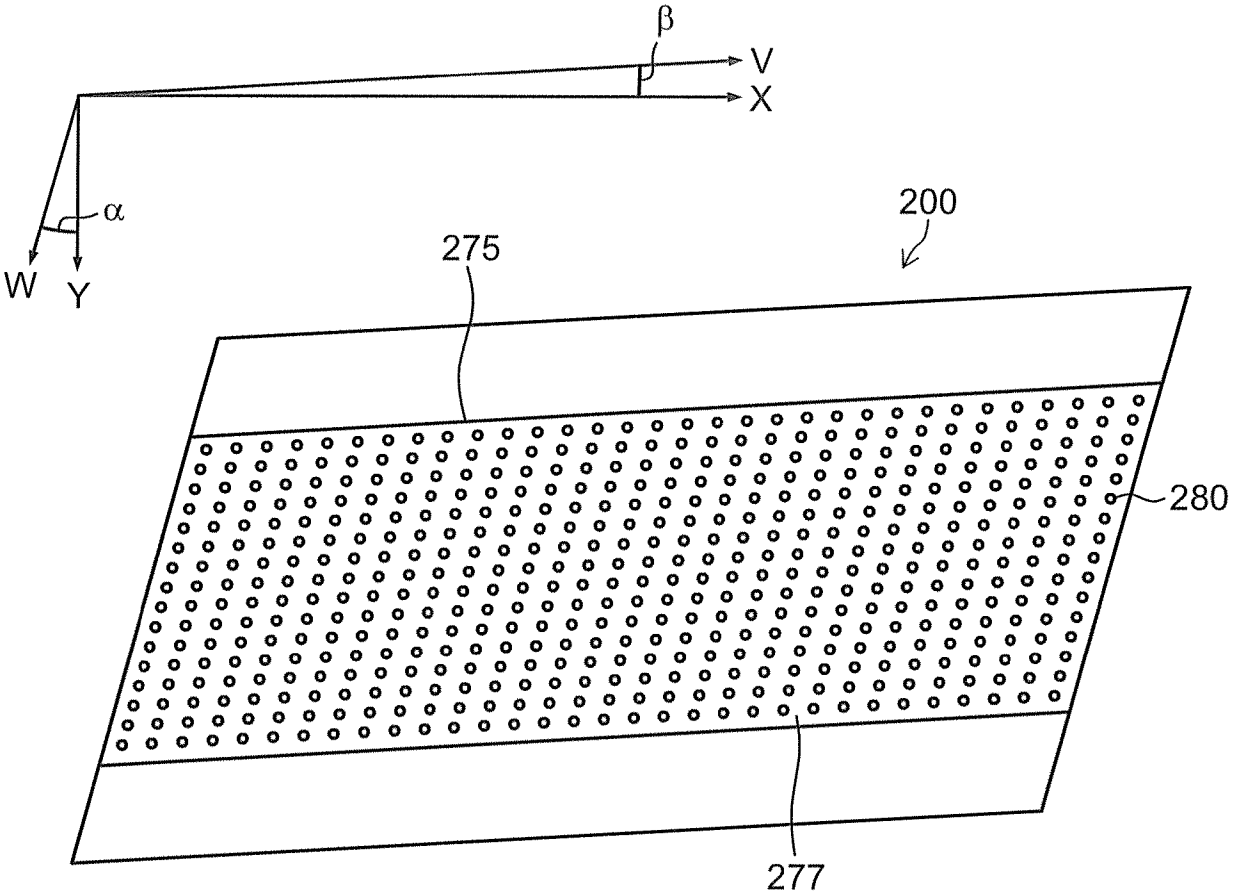
FIG. 5 is a perspective plan view of a liquid ejection surface in the head module.

An ejecting surface 277 of each of the head modules 200 included in the liquid ejection head 56 has a plurality of nozzle openings arranged thereon. The nozzle openings are not illustrated in FIG. 3. The nozzle openings are illustrated in FIG. 5 and designated by reference numeral 280.

The embodiment exemplifies the full-line type liquid ejection head 56, but serial printing may be applied in which image formation on an entire surface of the paper sheet is performed by repeating such an operation that a serial type liquid ejection head having a shorter length not reaching the entire width $L_{max}$ of the paper sheet S is moved in the paper sheet width direction to perform image formation for one time in the paper sheet width direction, and after completion of the image formation for one time in the paper sheet width direction, the paper sheet S is conveyed by a certain amount in the paper sheet conveying direction to perform image formation for the next area in the paper sheet width direction.

<Exemplary Structure of Head Module>

Next, a description is given of the head module in detail.

Figure 4:
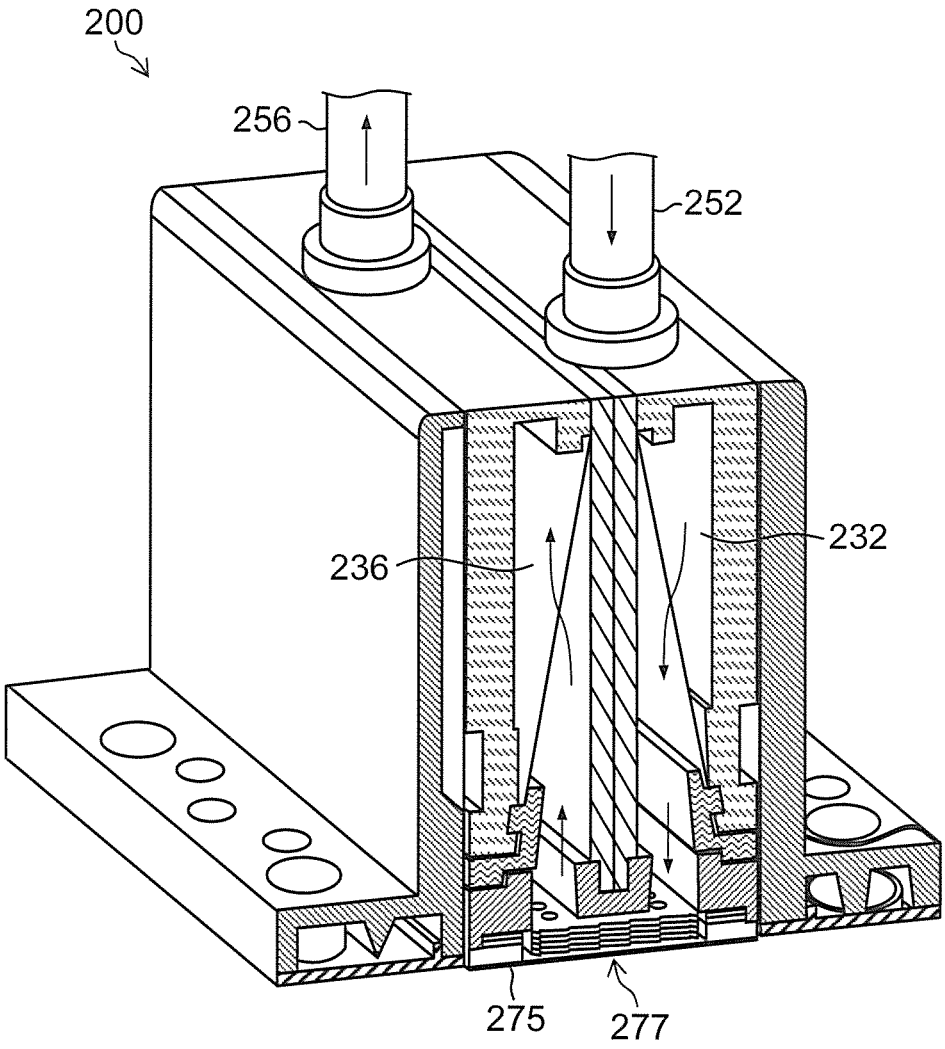
FIG. 4 is a perspective view of a head module, including a partial cross-sectional view.

FIG. 4 is a perspective view of the head module, including a partial cross-sectional view. FIG. 5 is a perspective plan view of a liquid ejection surface in the head module.

As illustrated in FIG. 4, the head module 200 includes an ink supply unit. The ink supply unit includes an ink supply chamber 232 and an ink circulating chamber 236.

The ink supply chamber 232 and the ink circulating chamber 236 are arranged on an opposite side of the ejecting surface 277 on a nozzle plate 275. The ink supply chamber 232 is connected via a supply conduit 252 with an ink tank not illustrated. The ink circulating chamber 236 is connected via a circulating conduit 256 with a collecting tank not illustrated.

The nozzle openings 280 are not illustrated in FIG. 5. On a plane of the ejecting surface 277 that the nozzle plate 275 has for one head module 200, the plural nozzle openings 280 are arranged in a two-dimensional arrangement.

In other words, the head module 200 has a planar shape of a parallelogram in which an end face on a long side is along a V direction inclined by an angle β with respect to the X direction and an end face on a short side is along a W direction inclined by an angle a with respect to the Y direction, and the plural nozzle openings 280 are arranged in a matrix arrangement in a row direction along the V direction and a column direction along the W direction.

The arrangement of the nozzle openings 280 is not limited to the aspect illustrated in FIG. 5, and the plural nozzle openings 280 may be arranged in a row direction along the X direction and in a column direction obliquely crossing the X direction.

Here, the matrix arrangement of the nozzle openings 280 is an arrangement of the nozzle openings 280 in which an arrangement distance interval between the nozzle openings 280 is uniform in a projected nozzle alignment in the X direction which is obtained by projecting the plural nozzle openings 280 in the X direction to arrange the plural nozzle openings 280 along the X direction.

The liquid ejection head 56 illustrated in the embodiment has, at a linked portion between the head modules 200 adjacent to each other in the projected nozzle alignment in the X direction, the nozzle openings 280 belonging to one head module 200 and the nozzle openings 280 belonging to the other head module 200 which mixedly exist.

If the head modules 200 have no installation position error, the nozzle openings 280 belonging to one head module 200 and the nozzle openings 280 belonging to the other head module 200 at a linked region are arranged at the same positions, and thus, the arrangement of the nozzle openings 280 is uniform also at the linked region.

In the following description, assume that the head modules 200 included in the liquid ejection head 56 are installed with installation position error.

<Internal Structure of Head Module>

FIG. 6 is a cross-sectional view illustrating an internal structure of the head module. The head module 200 includes an ink supply path 214, an individual supply path 216, a pressure chamber 218, a nozzle communicating channel 220, a circulating individual flow channel 226, a circulating common flow channel 228, a piezo element 230, and a diaphragm 266.

The ink supply path 214, the individual supply path 216, the pressure chamber 218, the nozzle communicating channel 220, the circulating individual flow channel 226, and the circulating common flow channel 228 are formed in a flow channel structure 210. The nozzle unit 281 may include the nozzle opening 280 and the nozzle communicating channel 220.

The individual supply path 216 is a flow channel communicating between the pressure chamber 218 and the ink supply path 214. The nozzle communicating channel 220 is a flow channel communicating between the pressure chamber 218 and the nozzle openings 280. The circulating individual flow channel 226 is a flow channel communicating between the nozzle communicating channel 220 and the circulating common flow channel 228.

The diaphragm 266 is provided on the flow channel structure 210. The piezo element 230 is arranged via a bonding layer 267 on the diaphragm 266. The piezo element 230 has a layered structure of a lower electrode 265, a piezoelectric body layer 231, and an upper electrode 264.

The lower electrode 265 may be called a common electrode and the upper electrode 264 may be called an individual electrode in some cases.

The upper electrode 264 is an individual electrode patterned corresponding to a shape of each pressure chamber 218 and is provided with the piezo element 230 for each pressure chamber 218.

The ink supply path 214 communicates with the ink supply chamber 232 illustrated in FIG. 4. The ink is supplied from the ink supply path 214 via the individual supply path 216 to the pressure chamber 218. When the drive voltage is applied to the upper electrode 264 of the piezo element 230 to be operated depending on the image data, the piezo element 230 and the diaphragm 266 are deformed to change a volume of the pressure chamber 218.

The head module 200 can eject ink droplets from the nozzle openings 280 via the nozzle communicating channel 220 by means of a pressure change involved by the change of the volume of the pressure chamber 218.

The head module 200 controls the piezo element 230 to be driven correspondingly to each nozzle opening 280 depending on the dot data generated from the image data to allow the ink droplet to be ejected from the nozzle opening 280.

While the paper sheet S illustrated in FIG. 3 is conveyed at a certain speed in the paper sheet conveying direction, the ejection timing of the ink droplet from each nozzle opening 280 illustrated in FIG. 5 is controlled to be adjusted to a conveyance speed of the paper sheet S, forming a desired image on the paper sheet S.

The pressure chamber 218 provided corresponding to each nozzle opening 280 has a substantially square planar shape not illustrated in the figure, an outlet port to the nozzle opening 280 is provided on one corner of a diagonal, and the individual supply channel 216 as an inlet port is provided on the other corner thereof.

The shape of the pressure chamber is not limited to a square. The planar shape of the pressure chamber may adopt various modes including a quadrilateral shape such as diamond shape and rectangular shape, a pentagonal shape, a hexagonal shape, or other polygonal shape, or a circular shape, elliptical shape, or the like.

The nozzle unit 281 including the nozzle openings 280 and the nozzle communicating channel 220 has a circulation outlet port formed therein not illustrated in the figure. The nozzle unit 281 is communicated via the circulation outlet port with the circulating individual flow channel 226. Of the ink in the nozzle unit 281, ink not used for ejection is collected via the circulating individual flow channel 226 into the circulating common flow channel 228.

The circulating common flow channel 228 communicates with the ink circulating chamber 236 illustrated in FIG. 4. The ink is always collected through the circulating individual flow channel 226 into the circulating common flow channel 228, preventing the ink in the nozzle unit from thickening during a non-ejection time period.

FIG. 6 exemplifies an example of the piezo element 230 which has a structure individually separated corresponding to each nozzle opening 280. Of course, a structure may be adopted in which the piezoelectric body layer 231 is formed integrally for the plural nozzle units 281, the individual electrode is formed corresponding to each nozzle unit 281, and an active region is formed for each nozzle unit 281.

The head module 200 may include a heater inside the pressure chamber 218 as a pressure generating element in place of the piezo element. A thermal method may be applied to the head module 200 in which the drive voltage is supplied to the heater to generate heat, and a film boiling phenomenon is used to eject the ink in the pressure chamber 218 from the nozzle opening 280.

Detailed Explanation of Maintenance Unit

Next, a description is given of the maintenance unit in detail. In the following description, assume that the liquid ejection head 56C, the liquid ejection head 56M, the liquid ejection head 56Y, and the liquid ejection head 56K each have an arrangement in which the ejecting surface is parallel to a horizontal plane.

As in the liquid ejection head 56C, the liquid ejection head 56M, the liquid ejection head 56Y, and the liquid ejection head 56K, which are illustrated in FIG. 1, in a case where the ejecting surface 277 is arranged inclined with respect to the horizontal plane, the maintenance unit may be arranged inclined corresponding to the inclination of the ejecting surface 277 with respect to the horizontal plane.

Figure 7:
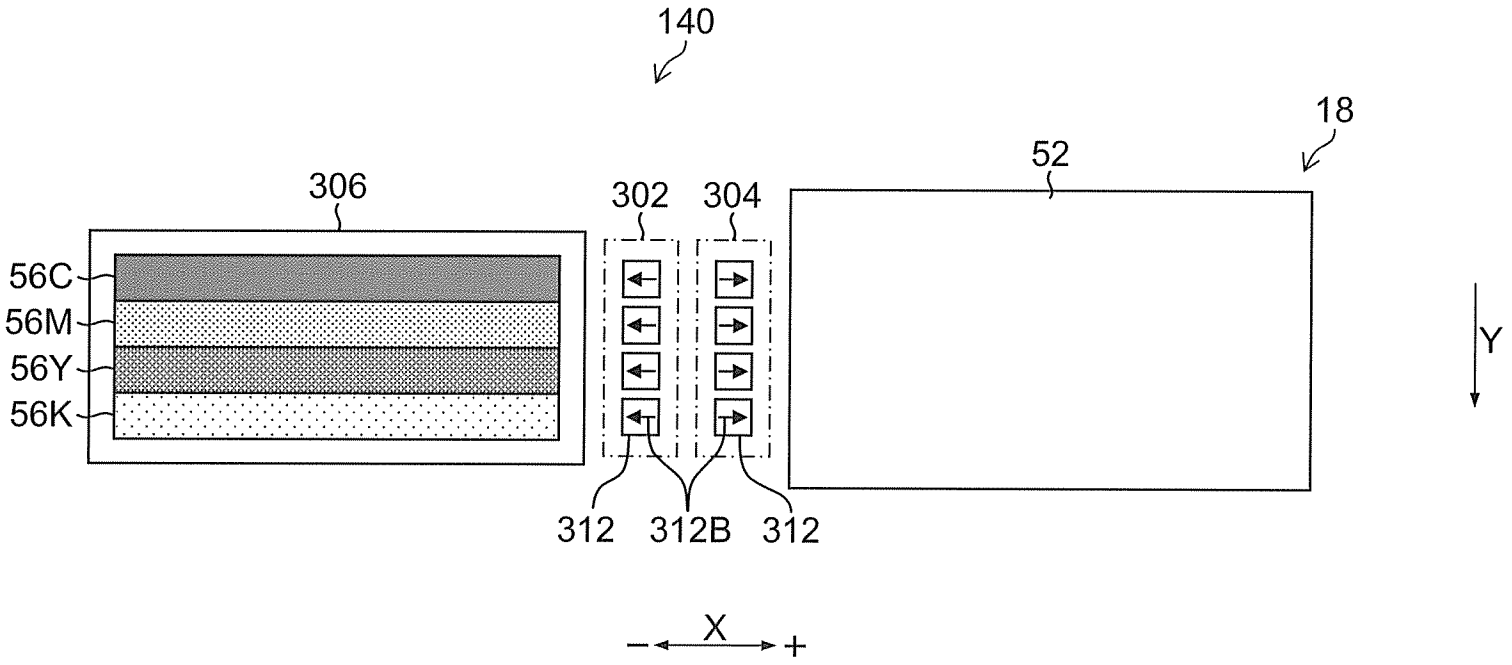
FIG. 7 is a schematic view illustrating an arrangement of a maintenance unit according to a first embodiment.
Figure 8:
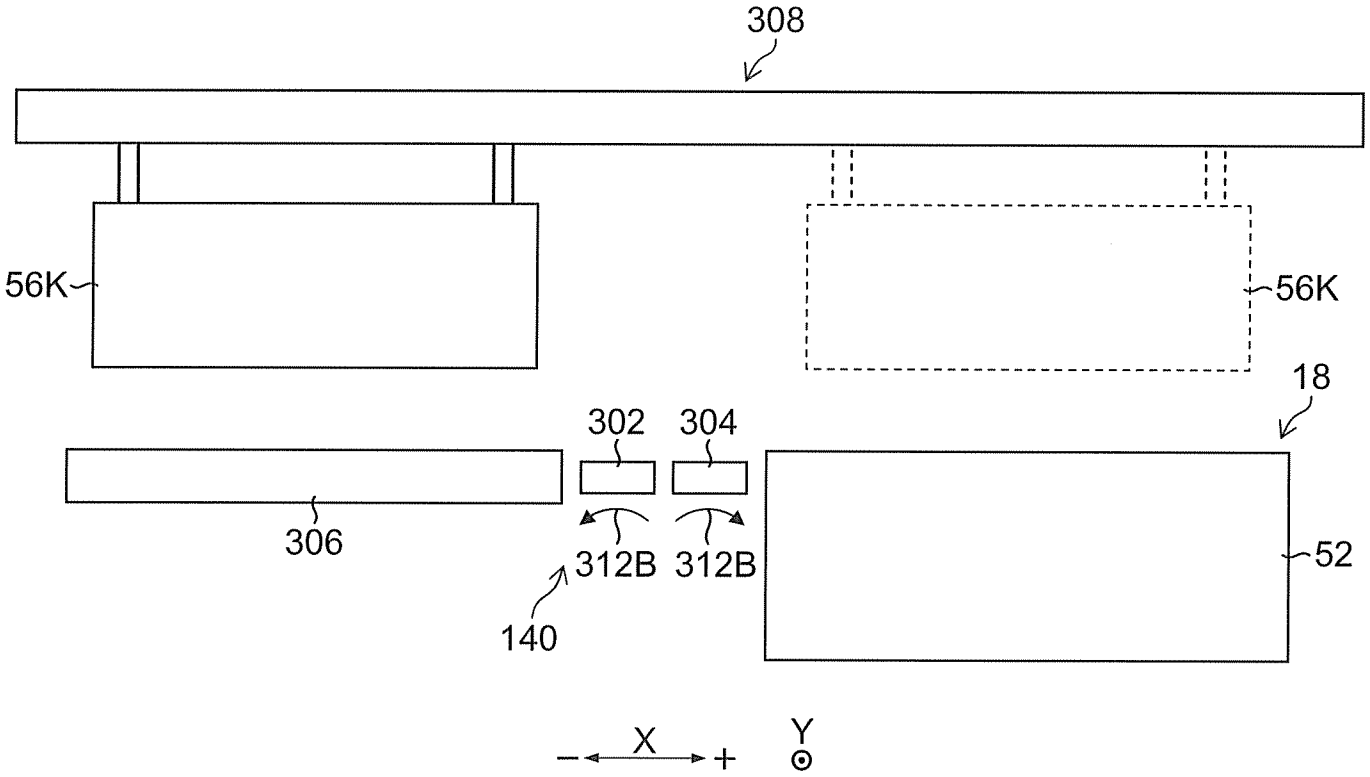
FIG. 8 is a schematic view illustrating an arrangement of the maintenance unit according to the first embodiment.

FIG. 7 and FIG. 8 each are a schematic view illustrating an arrangement of the maintenance unit according to a first embodiment. FIG. 7 is a view around the maintenance unit 140 and the image drawing unit 18 viewed from the upper side of the inkjet recording apparatus 10 illustrated in FIG. 1. FIG. 8 is a view around the maintenance unit 140 and the image drawing unit 18 viewed from the downstream side of the paper sheet conveyance of the inkjet recording apparatus 10 illustrated in FIG. 1.

FIG. 8 illustrates only the liquid ejection head 56K, of the liquid ejection head 56C, the liquid ejection head 56M, the liquid ejection head 56Y, and the liquid ejection head 56K, which are illustrated in FIG. 7.

The maintenance unit 140 illustrated in FIG. 7 includes a first wiping unit 302, a second wiping unit 304, and a capping unit 306. As illustrated in FIG. 8, the maintenance unit 140 also includes a head moving unit 308.

The capping unit 306 is attached to the liquid ejection head 56C, the liquid ejection head 56M, the liquid ejection head 56Y, and the liquid ejection head 56K, which are illustrated in FIG. 7.

The maintenance unit 140 illustrated in FIG. 7 and FIG. 8 has a structure in which the second wiping unit 304, the first wiping unit 302, and the capping unit 306 are arranged in this order from a side closest to the image drawing unit 18 in a head moving direction parallel to the paper sheet width direction which is designated by reference character X in FIG. 3 or the like.

A description of the head moving direction is made in detail later. Hereinafter, reference character X representing the paper sheet width direction is used as reference character representing the head moving direction. A sign "+" in FIG. 7 and FIG. 8 represents a positive direction of the head moving direction. A sign "−" in FIG. 7 and FIG. 8 represents a negative direction of the head moving direction. The liquid ejection head 56K illustrated using a broken line in FIG. 8 illustrates the liquid ejection head 56K which is arranged at image drawing position.

The first wiping unit 302 and the second wiping unit 304 function as a device which cleans the ejecting surfaces of the liquid ejection head 56C, the liquid ejection head 56M, the liquid ejection head 56Y, and the liquid ejection head 56K.

The first wiping unit 302 and the second wiping unit 304 are arranged between the image drawing unit 18 and the capping unit 306 in the head moving direction. Assume that the first wiping unit 302 is closer to the capping unit 306, and the second wiping unit 304 is farther from the capping unit 306.

The first wiping unit 302 and the second wiping unit 304 make traveling webs 312 into contact with the same area on the ejecting surface to wipe dirt such as the ink adhered to the relevant area on the ejecting surface.

An arrow 312B illustrated in FIG. 7 and a curved arrow 312B illustrated in FIG. 8 illustrate traveling directions of the webs in the first wiping unit 302 and the second wiping unit 304. In FIG. 7, only the lowermost webs in FIG. 7 respectively of the first wiping unit 302 and the second wiping unit 304 are designated by reference numeral 312 representing the web with reference numeral and character 312B representing the traveling direction, for the purpose of illustration.

The capping unit 306 functions as a device which protects the ejecting surfaces of the liquid ejection head 56C, the liquid ejection head 56M, the liquid ejection head 56Y, and the liquid ejection head 56K. Examples of ejecting surface protection may include preventing the ink in the nozzle unit formed on the ejecting surface from drying.

In a non-image drawing time period while the image drawing is not performed, the liquid ejection head 56C, the liquid ejection head 56M, the liquid ejection head 56Y, and the liquid ejection head 56K are arranged at a capping position that is a position of the capping unit 306.

Then, the capping unit 306 is attached to the ejecting surfaces of the liquid ejection head 56C, the liquid ejection head 56M, the liquid ejection head 56Y, and the liquid ejection head 56K.

The capping unit 306 is shared by a purge unit when performing the purge treatment on the liquid ejection head 56C, the liquid ejection head 56M, the liquid ejection head 56Y, and the liquid ejection head 56K.

During a purge treatment time period while the purge treatment is performed, the liquid ejection head 56C, the liquid ejection head 56M, the liquid ejection head 56Y, and the liquid ejection head 56K are arranged at the capping position.

Then, in a state where the capping unit 306 is attached to the ejecting surfaces of the liquid ejection head 56C, the liquid ejection head 56M, the liquid ejection head 56Y, and the liquid ejection head 56K, the purge treatment is performed on the liquid ejection head 56C, the liquid ejection head 56M, the liquid ejection head 56Y, and the liquid ejection head 56K.

The purge treatment is a treatment for continuously applying a positive pressure to the nozzle unit for a certain period of time to cause the ink to be ejected from the nozzle opening. Once the purge treatment is performed, it is possible to discharge outward bubbles, foreign matters and the like in the nozzle unit.

Examples of the certain period of time may include a period exceeding an operation time period of the nozzle unit during which the nozzle unit is made to operate to eject the ink on the basis of the drive voltage.

The head moving unit 308 is a device which moves the liquid ejection head 56C, the liquid ejection head 56M, the liquid ejection head 56Y, and the liquid ejection head 56K in the head moving direction between the image drawing position where the image drawing is performed and a maintenance position where maintenance is performed on the liquid ejection head 56C, the liquid ejection head 56M, the liquid ejection head 56Y, and the liquid ejection head 56K.

The maintenance position referred to here includes the capping position where the capping unit 306 is arranged in the head moving direction illustrated in FIG. 7 and the head wiping position where the first wiping unit 302 and the second wiping unit 304 are arranged in the head moving direction illustrated in FIG. 7.

The positive direction of the head moving direction in the embodiment is a direction from the capping unit 306 toward the image drawing unit 18. The negative direction of the head moving direction is a direction from the image drawing unit 18 toward the capping unit 306.

Examples of a configuration of the head moving unit 308 illustrated in FIG. 8 may include an aspect which is provided with a guide unit for supporting the liquid ejection head 56C, the liquid ejection head 56M, the liquid ejection head 56Y, and the liquid ejection head 56K illustrated in FIG. 7, and a movement mechanism such as a ball screw.

The head moving unit 308 illustrated in FIG. 8 may be provided to each of the liquid ejection head 56C, the liquid ejection head 56M, the liquid ejection head 56Y, and the liquid ejection head 56K illustrated in FIG. 7.

The head moving unit 308 illustrated in FIG. 8 may have a structure which collectively moves the liquid ejection head 56C, the liquid ejection head 56M, the liquid ejection head 56Y, and the liquid ejection head 56K illustrated in FIG. 7.

Detailed Explanation of Wiping Unit

Figure 9:
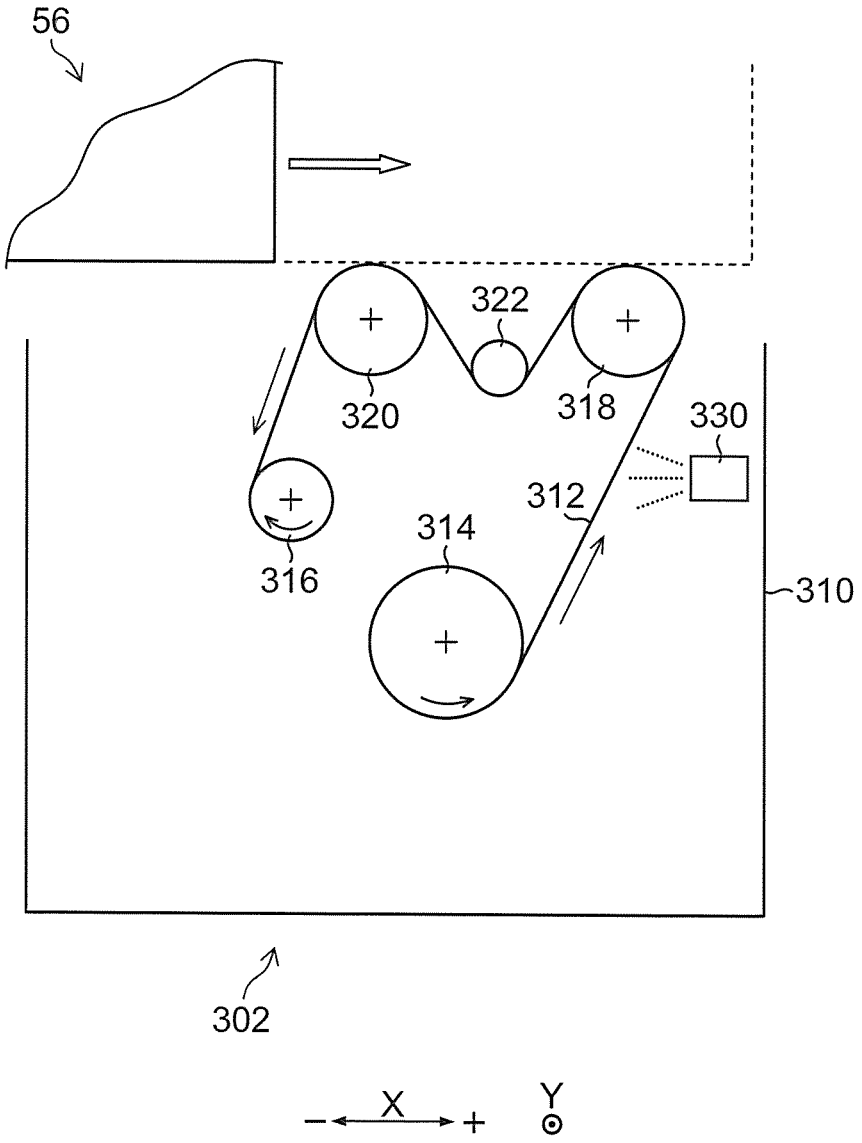
FIG. 9 is a schematic view illustrating an exemplary configuration of a wiping unit.

FIG. 9 is a schematic view illustrating an exemplary configuration of the wiping unit. A common structure may be applied to the first wiping unit 302 and the second wiping unit 304 illustrated in FIG. 7 and FIG. 8 except that the first and second wiping units have the traveling directions opposite to each other. Here, a description is given of the first wiping unit 302.

The first wiping unit 302 illustrated in FIG. 9 has a case 310 in which a web traveling path is formed to allow the web 312 to travel thereon. The web traveling path includes a reel-out shaft 314, a reel-in shaft 316, a first pressing roller 318, a second pressing roller 320, and a guide roller 322.

The web 312 formed into a belt shape is wound around the first pressing roller 318 and the second pressing roller 320. The first pressing roller 318 and the second pressing roller 320 each have a function of a pressing device which abuts the web 312 against the ejecting surface.

Materials for pressing portions of the first pressing roller 318 and second pressing roller 320 may include silicon, ethylene-propylene-diene rubber, or polyurethane.

Materials of the web 312 may include a microfiber knitted fabric or woven fabric made of polyethylene terephthalate, polyester, polyurethane, nylon or the like.

The reel-out shaft 314 is a shaft member for reeling out the web 312. The reel-in shaft 316 is a shaft member for reeling in the web 312. The guide roller 322 has a function as a guide member, between the first pressing roller 318 and the second pressing roller 320, for guiding the web 312 which is reeled out from the first pressing roller 318 and is reeled in by the second pressing roller 320.

The web 312 is reeled out from the reel-out shaft 314, wound around the first pressing roller 318, guided by the guide roller 322, wound around the second pressing roller 320, and reeled in by the reel-in shaft 316 to travel on the web conveying path.

The first pressing roller 318 and the second pressing roller 320 illustrated in FIG. 9 are arranged in a direction parallel with a longitudinal direction of the liquid ejection head 56C, the liquid ejection head 56M, the liquid ejection head 56Y, and the liquid ejection head 56K illustrated in FIG. 7.

The longitudinal direction of the liquid ejection head 56C, the liquid ejection head 56M, the liquid ejection head 56Y, and the liquid ejection head 56K is a direction perpendicular to the paper sheet conveying direction which is illustrated in FIG. 7 and designated by reference character X.

The first wiping unit 302 illustrated in FIG. 9 has the first pressing roller 318 arranged on an upstream side in the negative direction of the head moving direction, and the second pressing roller 320 arranged on a downstream side in the negative direction of the head moving direction.

The first wiping unit 302 illustrated in FIG. 9 is liftably and lowerably attached to a lifting and lowering unit not illustrated in the figure. The lifting and lowering unit moves the first wiping unit 302 between a wipe retracted position and a wipe treatment position. The wipe retracted position is on a lower side of the wipe treatment position.

Examples of a configuration of the lifting and lowering unit may include an aspect which is provided with a guide unit for liftably and lowerably supporting the first wiping unit 302, and a movement mechanism such as a ball screw.

As illustrated in FIG. 9, a cleaning liquid applying unit 330 may be included for applying a cleaning liquid to the web 312. The cleaning liquid applying unit 330 illustrated in FIG. 9 uses a non-contact applying scheme in which the cleaning liquid is jetted toward the web 312. The applying scheme for the cleaning liquid may be a contact applying scheme.

The cleaning liquid applying unit 330 illustrated in FIG. 9 is an aspect of each of a first cleaning liquid applying unit and a second cleaning liquid applying unit.

The second wiping unit 304 may be set to be in a direction opposite to the traveling direction of the web in the first wiping unit 302 illustrated in FIG. 9. For example, the first wiping unit 302 may be rotated by 180 degrees in a plane parallel with the ejecting surface. The positions of the reel-out shaft 314 and the reel-in shaft 316 in the first wiping unit 302 may be replaced with each other.

Explanation of Cleaning Method according to First Embodiment

Figure 10:
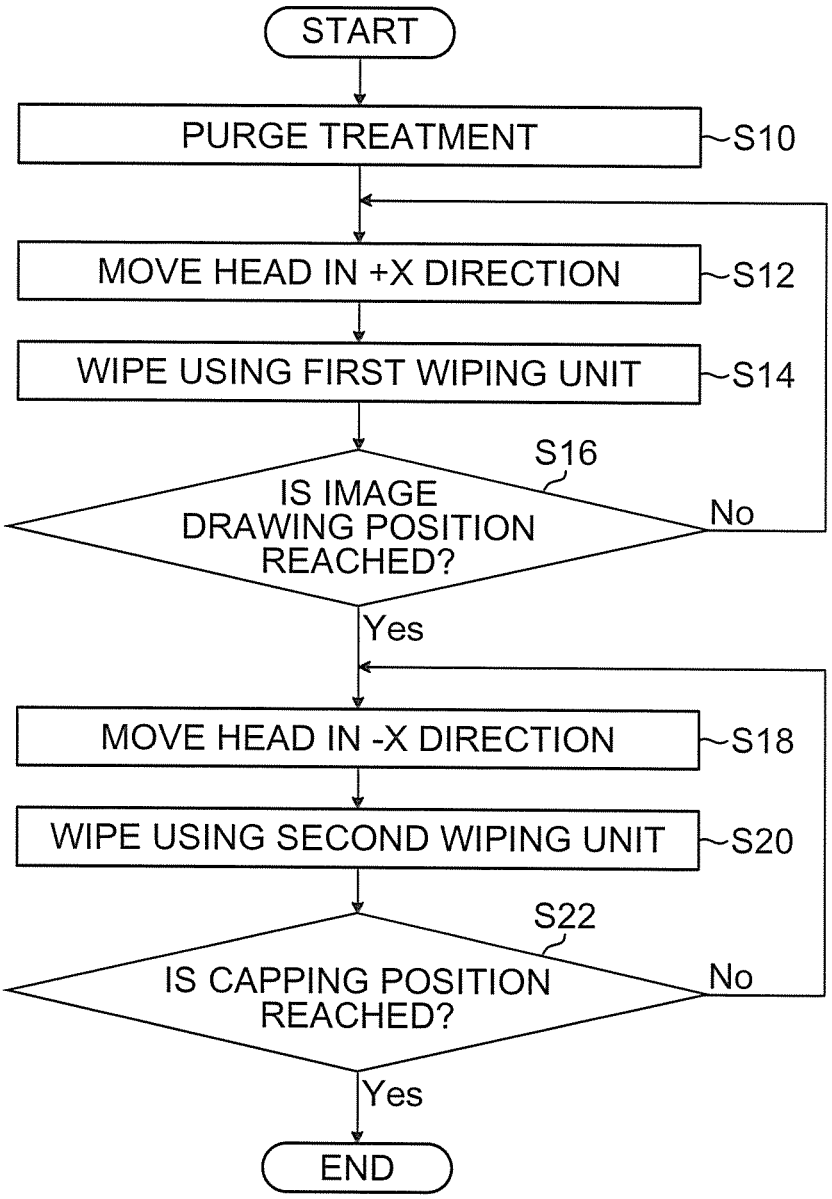
FIG. 10 is a flowchart illustrating a procedure of a cleaning method according to the first embodiment.

FIG. 10 is a flowchart illustrating a procedure of a cleaning method according to the first embodiment. The cleaning referred here can be read as wiping of the ejecting surface. The same goes for the following description.

When the cleaning of the ejecting surface is started, the purge treatment is performed at a purging step S10. In a case where the liquid ejection head 56C, the liquid ejection head 56M, the liquid ejection head 56Y, and the liquid ejection head 56K illustrated in FIG. 7 are arranged at the image drawing position, the purging step S10 illustrated in FIG. 10 may include a pre-purge head moving step of moving the liquid ejection head 56C, the liquid ejection head 56M, the liquid ejection head 56Y, and the liquid ejection head 56K from the image drawing position to the capping position.

The purging step S10 may be omitted. In a case where the purging step S10 is omitted, instead of the purging step, a capping releasing step is performed for removing from the ejecting surface the capping unit attached to the ejecting surfaces of the liquid ejection head 56C, the liquid ejection head 56M, the liquid ejection head 56Y, and the liquid ejection head 56K.

Next, a head first moving step S12 is performed. At the head first moving step S12, the liquid ejection head 56C, the liquid ejection head 56M, the liquid ejection head 56Y, and the liquid ejection head 56K illustrated in FIG. 7 are moved in the positive direction of the head moving direction. In FIG. 10, the positive direction of the head moving direction is represented as a +X direction.

At a first wiping step S14, wiping is performed of the ejecting surfaces of the liquid ejection head 56C, the liquid ejection head 56M, the liquid ejection head 56Y, and the liquid ejection head 56K illustrated in FIG. 7. The first wiping step S14 illustrated in FIG. 10 is to lift the first wiping unit 302 from the wipe retracted position and stop the first wiping unit 302 at the wipe treatment position, at a timing when the liquid ejection head 56C, the liquid ejection head 56M, the liquid ejection head 56Y, and the liquid ejection head 56K illustrated in FIG. 7 enter an area of wipe treatment by use of the first wiping unit 302.

When the liquid ejection head 56C, the liquid ejection head 56M, the liquid ejection head 56Y, and the liquid ejection head 56K pass through the area of wipe treatment by use of the first wiping unit 302, wipe treatment is performed using the first wiping unit 302 on the ejecting surfaces.

When the liquid ejection head 56C, the liquid ejection head 56M, the liquid ejection head 56Y, and the liquid ejection head 56K completely pass through the area of wipe treatment by use of the first wiping unit 302, the first wiping unit 302 is lowered from the wipe treatment position and the first wiping unit 302 is stopped at the wipe retracted position. The first wiping step S14 is an aspect of the cleaning of the ejecting surface which is performed using the first wiping unit for the first time after the purge treatment. In addition, the first wiping step S14 is an aspect of the cleaning of the ejecting surface which is performed using the first wiping unit for the first time in the case of not performing the purge treatment.

An image drawing position reach determining step S16 illustrated in FIG. 10 is to determine whether or not the liquid ejection head 56C, the liquid ejection head 56M, the liquid ejection head 56Y, and the liquid ejection head 56K illustrated in FIG. 7 reach the image drawing position.

If the image drawing position reach determining step S16 illustrated in FIG. 10 makes a NO determination, that is, if it is determined that the liquid ejection head 56C, the liquid ejection head 56M, the liquid ejection head 56Y, and the liquid ejection head 56K illustrated in FIG. 7 do not reach the image drawing position, the head first moving step S12 and the first wiping step S14 illustrated in FIG. 10 are continued.

On the other hand, if the image drawing position reach determining step S16 makes a YES determination, that is, if it is determined that the liquid ejection head 56C, the liquid ejection head 56M, the liquid ejection head 56Y, and the liquid ejection head 56K illustrated in FIG. 7 reach the image drawing position, a head second moving step S18 illustrated in FIG. 10 is performed.

The head second moving step S18 moves, in the negative direction of the head moving direction, the liquid ejection head 56C, the liquid ejection head 56M, the liquid ejection head 56Y, and the liquid ejection head 56K illustrated in FIG. 7 that are the liquid ejection head 56C, the liquid ejection head 56M, the liquid ejection head 56Y, and the liquid ejection head 56K which reach the image drawing position. In FIG. 10, the negative direction of the head moving direction is represented as a −X direction.

At a second wiping step S20, wiping is performed of the ejecting surfaces of the liquid ejection head 56C, the liquid ejection head 56M, the liquid ejection head 56Y, and the liquid ejection head 56K illustrated in FIG. 7. The second wiping step S20 illustrated in FIG. 10 is to lift the second wiping unit 304 from the wipe retracted position and stop the second wiping unit 304 at the wipe treatment position, at a timing when the liquid ejection head 56C, the liquid ejection head 56M, the liquid ejection head 56Y, and the liquid ejection head 56K illustrated in FIG. 7 enter an area of wipe treatment by use of the first wiping unit 304.

When the liquid ejection head 56C, the liquid ejection head 56M, the liquid ejection head 56Y, and the liquid ejection head 56K pass through the area of wipe treatment by use of the second wiping unit 304, the wipe treatment is performed using the second wiping unit 304 on the ejecting surfaces of the liquid ejection head 56C, the liquid ejection head 56M, the liquid ejection head 56Y, and the liquid ejection head 56K.

When the liquid ejection head 56C, the liquid ejection head 56M, the liquid ejection head 56Y, and the liquid ejection head 56K completely pass through the area of wipe treatment by use of the second wiping unit 304, the second wiping unit 304 is lowered from the wipe treatment position and the second wiping unit 304 is stopped at the wipe retracted position. The second wiping step S20 is an aspect of the cleaning of the ejecting surface which is performed using the second wiping unit after the initial cleaning of the ejecting surface using the first wiping unit after performing the purge treatment. In addition, the second wiping step S20 is an aspect of the cleaning of the ejecting surface which is performed using the second wiping unit after the initial cleaning of the ejecting surface using the first wiping unit in the case where the purge treatment is not performed.

A capping position reach determining step S22 illustrated in FIG. 10 is to determine whether or not the liquid ejection head 56C, the liquid ejection head 56M, the liquid ejection head 56Y, and the liquid ejection head 56K illustrated in FIG. 7 reach the capping position on a head moving path.

If the capping position reach determining step S22 makes a NO determination, that is, if it is determined that the liquid ejection head 56C, the liquid ejection head 56M, the liquid ejection head 56Y, and the liquid ejection head 56K illustrated in FIG. 7 do not reach the capping position, the head second moving step S18 and the second wiping step S20 illustrated in FIG. 10 are continued.

On the other hand, if the capping position reach determining step S22 makes a YES determination, that is, if it is determined that the liquid ejection head 56C, the liquid ejection head 56M, the liquid ejection head 56Y, and the liquid ejection head 56K illustrated in FIG. 7 reach the capping position, the cleaning method ends.

Action and Effect

In the cleaning method according to the first embodiment, the traveling direction of the web illustrated in FIG. 9 is a direction opposite to the moving direction of the liquid ejection head 56C, the liquid ejection head 56M, the liquid ejection head 56Y, and the liquid ejection head 56K illustrated in FIG. 7.

In other words, in the case where the liquid ejection head 56C, the liquid ejection head 56M, the liquid ejection head 56Y, and the liquid ejection head 56K are moved in the positive direction of the head moving direction, the wiping is performed by use of the first wiping unit 302 which makes the web travel in the negative direction of the head moving direction.

On the other hand, in the case where the liquid ejection head 56C, the liquid ejection head 56M, the liquid ejection head 56Y, and the liquid ejection head 56K are moved in the negative direction of the head moving direction, the wiping is performed by use of the second wiping unit 304 which makes the web travel in the positive direction of the head moving direction.

In this way, the web is made to travel in a direction opposite to the moving direction of the liquid ejection head 56C, the liquid ejection head 56M, the liquid ejection head 56Y, and the liquid ejection head 56K to wipe the ejecting surfaces and the ejecting surfaces are wiped both in the positive direction of the head moving direction and the negative direction of the head moving direction, which gives no un-wiped portion biasedly to one side in the head moving direction or the web traveling direction.

The web is made to travel in a direction opposite to the moving direction of the liquid ejection head 56C, the liquid ejection head 56M, the liquid ejection head 56Y, and the liquid ejection head 56K to wipe the ejecting surfaces, so that the web during the wiping is not loosened to enable a stable wiping.

The first wiping unit 302 closer to the capping unit 306 is used for the wiping for the first time after the purge treatment is performed on the liquid ejection head 56C, the liquid ejection head 56M, the liquid ejection head 56Y, and the liquid ejection head 56K, which makes it possible to wipe the ejecting surfaces immediately after performing the purge treatment, suppressing dropping down of the residual liquid remaining on the ejecting surfaces or solidification of the residual liquid remaining on the ejecting surfaces.

Modification Example

In the embodiment, the traveling direction of the web 312 in the first wiping unit 302 is parallel with the longitudinal direction of the liquid ejection head, but the traveling direction of the web 312 in the first wiping unit 302 may be a direction crossing the longitudinal direction of the liquid ejection head. Similarly, the traveling direction of the web in the second wiping unit 304 may be a direction crossing the longitudinal direction of the liquid ejection head.

In the embodiment, the traveling direction of the web in the second wiping unit 304 is a direction opposite to the traveling direction of the web 312 in the first wiping unit 302, but the traveling direction of the web in the second wiping unit 304 may be a direction having a component of the direction opposite to the traveling direction of the web 312 in the first wiping unit 302.

The traveling direction of the web 312 in the first wiping unit 302 shown in the embodiment is an aspect of a first direction. The traveling direction of the web in the second wiping unit 304 shown in the embodiment is an aspect of a second direction.

The head moving unit 308 shown in the embodiment is an aspect of a relative moving unit. In other words, moving of the liquid ejection head 56C, the liquid ejection head 56M, the liquid ejection head 56Y, and the liquid ejection head 56K in the head moving direction is an aspect of relative moving between the first wiping unit and the liquid ejection head, and an aspect of relative moving between the second wiping unit and the liquid ejection head.

The moving direction of the liquid ejection head 56C, the liquid ejection head 56M, the liquid ejection head 56Y, and the liquid ejection head 56K by used of the head moving unit 308 is an aspect of a relative moving direction and an aspect of a moving direction of the liquid ejection head with reference to the first wiping unit in the relative moving between the first wiping unit and the liquid ejection head.

The moving direction of the liquid ejection head 56C, the liquid ejection head 56M, the liquid ejection head 56Y, and the liquid ejection head 56K by use of the head moving unit 308 is an aspect of a moving direction of the liquid ejection head with reference to the second wiping unit in the relative moving between the second wiping unit and the liquid ejection head.

In place of the head moving unit 308, a relative moving unit may be included in which the first wiping unit 302 and the second wiping unit 304 are moved in the head moving direction with respect to the liquid ejection head 56C, the liquid ejection head 56M, the liquid ejection head 56Y, and the liquid ejection head 56K with their positions in the head moving direction being fixed.

In place of the head moving unit 308, a relative moving unit may be included in which both the units and the heads that are the first wiping unit 302 and the second wiping unit 304 as well as the liquid ejection head 56C, the liquid ejection head 56M, the liquid ejection head 56Y, and the liquid ejection head 56K are moved in the head moving direction.

The embodiment exemplifies the aspect in which the head moving direction in wiping the ejecting surfaces using the first wiping unit 302 is a direction opposite to the traveling direction of the web 312 in the first wiping unit 302, but the head moving direction in wiping the ejecting surfaces using the first wiping unit 302 may be a direction having a component of the direction opposite to the traveling direction of the web 312 in the first wiping unit 302.

Similarly, the head moving direction in wiping the ejecting surfaces using the second wiping unit 304 may be a direction having a component of the direction opposite to the traveling direction of the web in the second wiping unit 304.

The modification example shown here can be applied also to a second embodiment, a third embodiment, and a fourth embodiment which are described below.

Explanation of Wiping Time Period Absorption Volume of Web

In the maintenance unit 140 according to the embodiment, a relationship between a first wiping time period absorption volume $Q_1$ that is a wiping time period absorption volume of the web 312 in the first wiping unit 302, and a second wiping time period absorption volume $Q_2$ that is a wiping time period absorption volume of the web in the second wiping unit 304 satisfies the next formula:

$$Q_1 \geq Q_2.$$

The first wiping time period absorption volume $Q_1$ shown in the embodiment corresponds to a first cleaning time period absorption volume $Q_1$. The second wiping time period absorption volume $Q_2$ shown in the embodiment corresponds to a second cleaning time period absorption volume $Q_2$.

The wiping time period absorption volume $Q_1$ of the web 312 in the first wiping unit 302 is a liquid absorption volume which can be absorbed by the web 312 in the first wiping unit 302 during the wiping time period for the ejecting surface 277 using the first wiping unit 302. The liquid absorption volume is represented by a volume of liquid. The wiping time period absorption volume $Q_2$ of the web in the second wiping unit 304 is a volume of liquid which can be absorbed by the web in the second wiping unit 304 during the wiping time period for the ejecting surface 277 using the second wiping unit 304.

Figure 11:
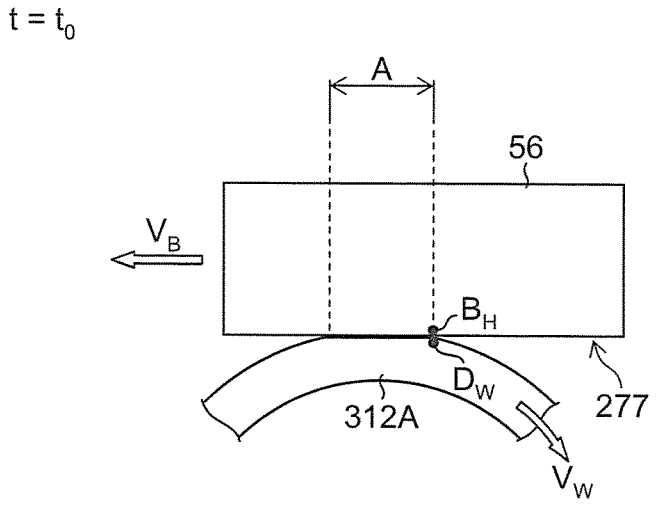
FIG. 11 is an illustration of a wiping time period absorption volume of a web.
Figure 12:
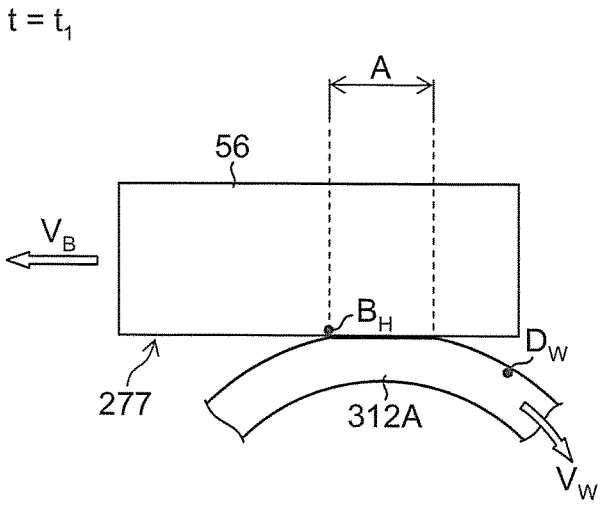
FIG. 12 is an illustration of a wiping time period absorption volume of the web.

FIG. 11 and FIG. 12 each are an illustration of the wiping time period absorption volume of the web. FIG. 11 is a schematic view at a timing $t_0$ when the wiping at an arbitrary position $B_H$ on the ejecting surface is started. FIG. 12 is a schematic view at a timing after elapse of a time period $t_1$ from the timing $t_0$ when the wiping at the arbitrary position $B_H$ on the ejecting surface is started. A position $D_W$ is a position on the web where the position $B_H$ is wiped at the timing $t_0$ illustrated in FIG. 11.

In FIG. 11, the web is designated by reference numeral and character 312A for the convenience of illustration. The web 312 illustrated in FIG. 11 represents the web 312 included in the first wiping unit 302 illustrated in FIG. 9 or the web included the second wiping unit 304.

Additionally, in FIG. 11, the liquid ejection head is designated by reference numeral 56 for the convenience of illustration. The liquid ejection head 56 illustrated in FIG. 11 represents any of the liquid ejection head 56C, the liquid ejection head 56M, the liquid ejection head 56Y, and the liquid ejection head 56K illustrated in FIG. 7.

A wiping time period absorption volume of the web 312A is represented by a formula described later. In the formula below, $V_W$ is an absolute value of a traveling velocity of the web 312A in an area where the web 312A contacts with the ejecting surface of the liquid ejection head, and $V_B$ is an absolute value of a relative velocity between the liquid ejection head and the web 312A in the area where the web 312A contacts with the ejecting surface of the liquid ejection head. A represents a nip width of the web 312A that is a length of the web 312A abutted on the ejecting surface, and $Q_0$ is an absorption volume per unit length in the traveling direction of the web 312A.

Hereinafter, $V_W$ is represented as the traveling velocity of the web 312A. $V_B$ is represented as the relative velocity between the liquid ejection head 56 and web 312A. The area where the web 312A contacts with the liquid ejection head is an aspect of an area where the first wiping member contacts with the ejecting surface. The area where the web 312A contacts with the liquid ejection head is an aspect of the area where the second wiping member contacts with the ejecting surface.

The wiping time period absorption volume of the web$=\{1+(V_W/V_B)\}\times A\times Q_0$ As for the traveling direction of the web 312A illustrated by a curved arrow and a direction opposite to the moving direction of the liquid ejection head 56 illustrated by an arrow, a direction of the traveling velocity $V_W$ of the web 312A and a direction of the relative velocity $V_B$ between the liquid ejection head 56 and the web 312A are defined.

The reason why the above formula is used to define the absorption volume of the web 312A during the wiping time period is as follows. A length T of the web 312A wiping the arbitrary position $B_H$ on the ejecting surface 277 for the time period t from the timing to to the timing $t_1$ is obtained by a formula: $T=A+V_W\times t$.

The time period t is expressed by $t=A/V_B$. Then, the length T of the web 312A wiping the arbitrary position $B_H$ on the ejecting surface 277 is expressed by $T=A+V_W\times A/V_B=\{1+(V_W/V_B)\}\times A$. By multiplying the length T of the web 312A wiping the arbitrary position $B_H$ on the ejecting surface 277 by the absorption volume Q per unit length in the traveling direction of the web 312A, the absorption volume of the web 312A during the wiping time period can be obtained.

The absorption volume $Q_0$ per unit length in the traveling direction of the web 312A is a fixed value depending on a kind of the web 312A. The kind of the web 312A referred here may be a material of the web 312A or a structure of the web 312A. Examples of the structure of the web may include a size of a spacing, a weave type, a knitting type.

Assuming that a traveling velocity of the web 312 in the first wiping unit 302 is $V_{W1}$, a relative velocity between the liquid ejection head 56 and the web 312 in the first wiping unit 302 is $V_{B1}$, a nip width of the web 312 in the first wiping unit 302 is $A_1$, and an absorption volume per unit length in the traveling direction of the web 312 in the first wiping unit 302 is $Q_{01}$, the first wiping time period absorption volume $Q_1$ is expressed by the next formula:

$$Q_1=\{1+(V_{W1}/V_{B1})\}\times A_1\times Q_{01}.$$

Similarly, assuming that a traveling velocity of the web in the second wiping unit 304 is $V_{W2}$, a relative velocity between the liquid ejection head 56 and the web in the second wiping unit 304 is $V_{B2}$, a nip width of the web in the second wiping unit 304 is $A_2$, and an absorption volume per unit length in the traveling direction of the web in the second wiping unit 304 is $Q_{02}$, the second wiping time period absorption volume $Q_2$ is expressed by the next formula:

$$Q_2=\{1+(V_{W2}/V_{B2})\}\times A_2\times Q_{02}.$$

Then, the wiping time period absorption volume $Q_1$ of the web 312 in the first wiping unit 302≥the wiping time period absorption volume $Q_2$ of the web in the second wiping unit 304 is set, and the web 312 in the first wiping unit 302 which has relatively larger wiping time period absorption volume is used to perform the wiping immediately after the purge treatment, ensuring that the residual liquid on the ejecting surface is absorbed.

The wiping immediately after the purge treatment referred here is the wiping of the ejecting surface for the first time after the purging step is performed in the case of performing the purging step S10 illustrated in FIG. 10.

Further, the web in the second wiping unit 304 having relatively smaller wiping time period absorption volume is used to perform a final wiping, so that the ink extracted by the web from the nozzle unit 281 illustrated in FIG. 6 is suppressed, which results in that a meniscus of the nozzle unit 281 illustrated in FIG. 6 is kept, allowing the ejection to be stable in the image drawing to be performed thereafter.

The final wiping referred here may be a wiping other than the wiping of the ejecting surface for the first time after the purging step is performed in the case of performing the purging step S10 illustrated in FIG. 10. The final wiping may include the wiping in the case of not performing the purging step S10.

In order to attain the first wiping time period absorption volume $Q_1$≥the second wiping time period absorption volume $Q_2$, the traveling velocity $V_{W1}$ of the web 312 in the first wiping unit 302 and the traveling velocity $V_{W2}$ of the web in the second wiping unit 304 may be adjusted.

Alternatively, the kinds of the web 312 in the first wiping unit 302 and the web in the second wiping unit 304 may be changed to adjust the absorption volume $Q_{01}$ per unit length in the traveling direction of the web 312 in the first wiping unit 302 and the absorption volume $Q_{02}$ per unit length in the traveling direction of the web in the second wiping unit 304.

Cleaning Liquid Application Amount

In the case where the cleaning liquid applying unit 330 illustrated in FIG. 9 is included, the application amount of the cleaning liquid may be as follows. Cleaning liquid application to the web 312 in the first wiping unit 302 by use of the cleaning liquid applying unit 330 and cleaning liquid application to the web in the second wiping unit 304 by use of the cleaning liquid applying unit 330 each are an aspect of a cleaning liquid applying step.

In a case where a first cleaning liquid application amount is $P_{1p}$ that is a cleaning liquid application amount to the web 312 in the first wiping unit 302 in the wiping for the first time after the purge, a second cleaning liquid application amount is $P_{1n}$ that is a cleaning liquid application amount to the web 312 in the first wiping unit 302 in the wiping with no purge being performed, a third cleaning liquid application amount is $P_{2p}$ that is a cleaning liquid application amount to the web in the second wiping unit 304 in the wiping for the last time after the purge, and a fourth cleaning liquid application amount is $P_{2n}$ that is a cleaning liquid application amount to the web in the second wiping unit 304 in the wiping with no purge being performed, the first cleaning liquid application amount $P_{1p}$, the second cleaning liquid application amount $P_{1n}$, and the third cleaning liquid application amount $P_{2p}$ satisfy the next formula:

$$0\leq P_{1p}<P_{2p}\leq P_{1n}.$$

The first cleaning liquid application amount $P_{1p}$, the second cleaning liquid application amount $P_{1n}$ and the fourth cleaning liquid application amount $P_{2n}$ satisfy the next formula:

$$0\leq P_{1p}<P_{2n}\leq P_{1n}.$$

However, a magnitude relationship between $P_{2p}$ and $P_{2n}$ may be any of $P_2<P_{2n}$, $P_{2p}=P_{2n}$, and $P_{2p}>P_{2n}$.

The cleaning liquid application amounts defined as above may give the following effects. The wiping by use of the first wiping unit 302 in the wiping for the first time after the purge treatment is performed mainly for the purpose of wiping the residual liquid remained on the ejecting surface as a result of the purge treatment, and thus, the first cleaning liquid application amount $P_{1p}$ may be relatively smaller. The cleaning liquid may not be applied.

If the first wiping time period absorption volume $Q_1$≥the second wiping time period absorption volume $Q_2$, in the case of not performing the purge treatment, the liquid is more absorbed in the wiping by use of the first wiping unit 302 than in the wiping by use of the second wiping unit 304, and therefore, by applying in advance more cleaning liquid relatively to the web 312 in the first wiping unit 302, the ink extracted from the nozzle unit 281 illustrated in FIG. 6 is suppressed in the wiping by use of the first wiping unit 302 in the case of not performing the purge treatment.

If the first wiping time period absorption volume $Q_1$≥the second wiping time period absorption volume $Q_2$, the ink is less likely to be extracted from the nozzle unit 281 illustrated in FIG. 6 in the wiping by use of the second wiping unit 304 than in the wiping by use of the first wiping unit 302, the therefore, the third cleaning liquid application amount $P_{2p}$ and the fourth cleaning liquid application amount $P_{2n}$ may be set to be more than the first cleaning liquid application amount $P_{1p}$ and less than the second cleaning liquid application amount $P_{1n}$.

Second Embodiment

Next, a description is given of a second embodiment. In the following description, a difference from the first embodiment is mainly explained. The description of the same configuration as the first embodiment is appropriately omitted.

Figure 13:
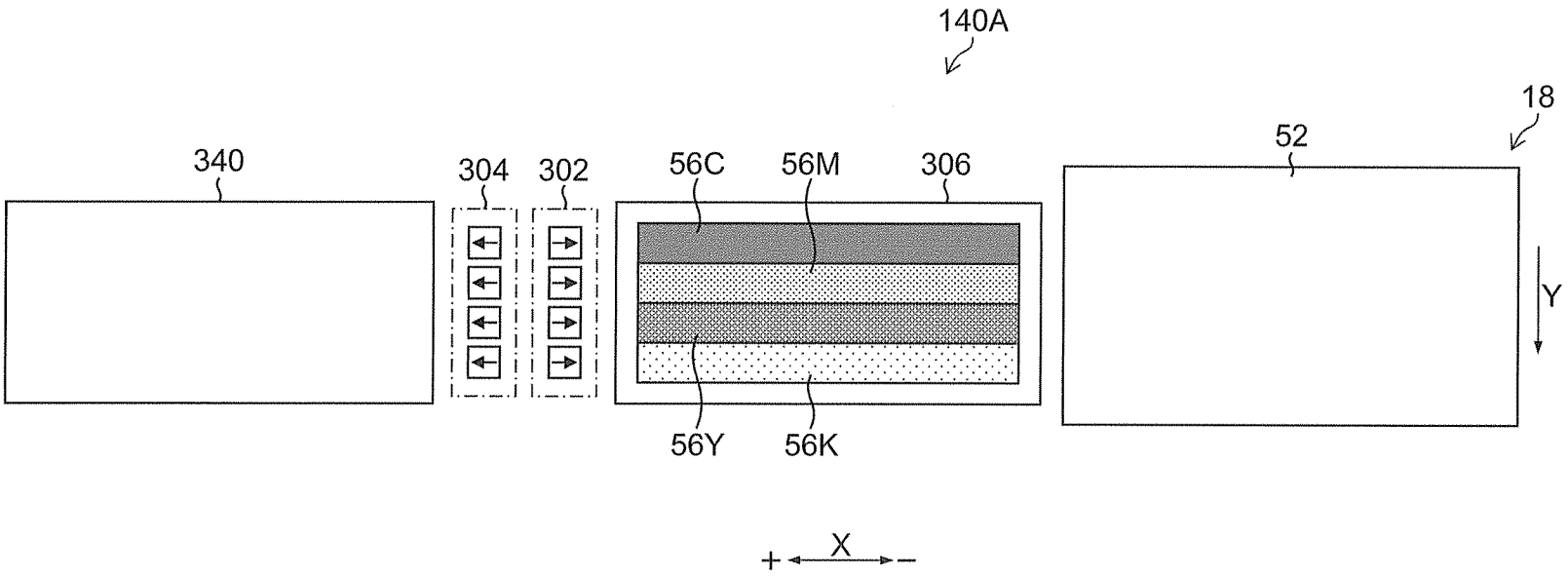
FIG. 13 is a schematic view illustrating an arrangement of a maintenance unit according to a second embodiment.

FIG. 13 is a schematic view illustrating an arrangement of a maintenance unit according to the second embodiment. FIG. 13 is, similarly to FIG. 7, a view around a maintenance unit 140A and the image drawing unit 18 viewed from the upper side of the inkjet recording apparatus 10 illustrated in FIG. 1.

The maintenance unit 140A illustrated in FIG. 13 includes a head retracting unit 340. The maintenance unit 140A illustrated in FIG. 13 has arranged therein the capping unit 306, the first wiping unit 302, the second wiping unit 304, and the head retracting unit 340 in this order from a side closer to the image drawing unit 18 in the head moving direction.

A positive direction of the head moving direction in the maintenance unit 140A illustrated in FIG. 13 is a direction from the capping unit 306 toward the head retracting unit 340. A negative direction of the head moving direction is a direction from the head retracting unit 340 toward the capping unit 306.

Figure 14:
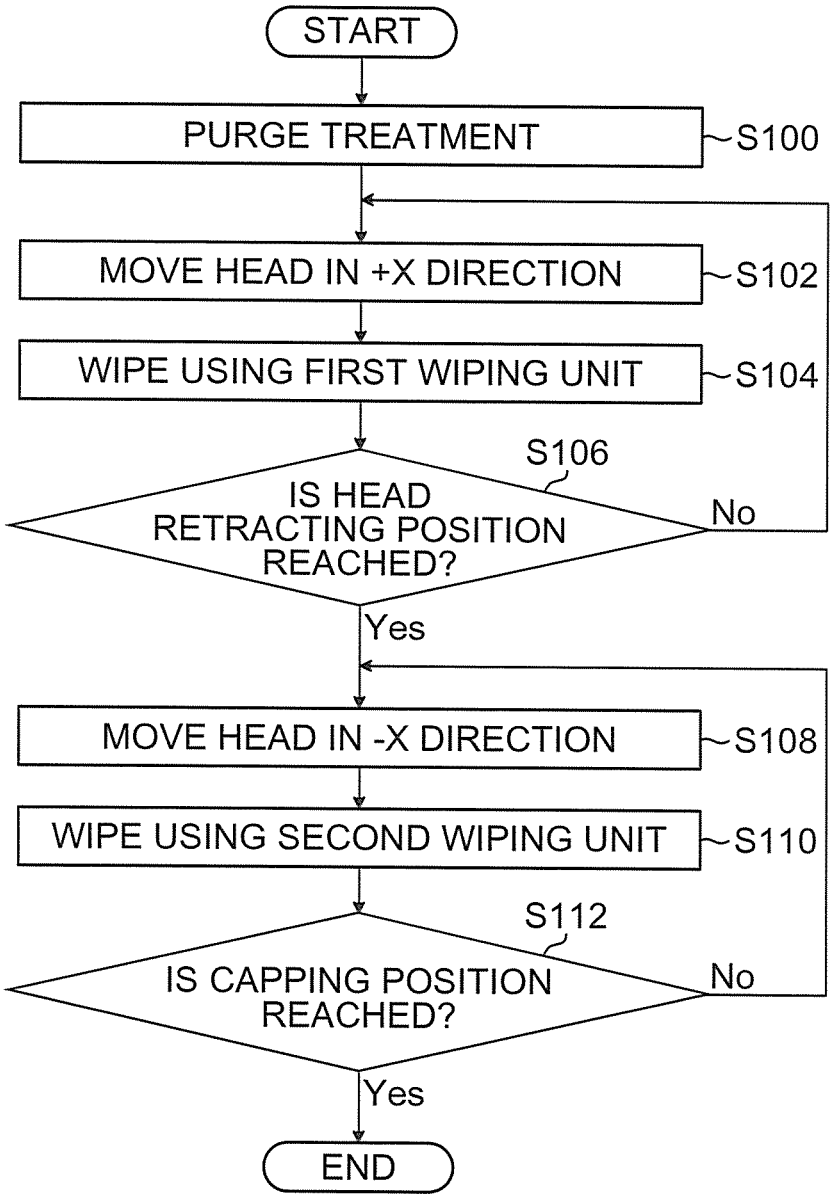
FIG. 14 is a flowchart illustrating a procedure of a cleaning method according to the second embodiment.

FIG. 14 is a flowchart illustrating a procedure of a cleaning method according to the second embodiment. The flowchart illustrated in FIG. 14 shows a head retracting position reach determining step S106 in place of the image drawing position reach determining step S16 illustrated in FIG. 10.

The head retracting position reach determining step S106 illustrated in FIG. 14 is to determine whether or not the liquid ejection head 56C, the liquid ejection head 56M, the liquid ejection head 56Y, and the liquid ejection head 56K reach a head retracting position that is a position of the head retracting unit 340 illustrated in FIG. 13 during performing a head first moving step S102 and a first wiping step S104.

A purging step S100, the head first moving step S102, and the first wiping step S104 illustrated in FIG. 14 correspond to the purging step S10, the head first moving step S12, and the first wiping step S14 illustrated in FIG. 10, respectively.

If the head retracting position reach determining step S106 illustrated in FIG. 14 makes a NO determination, that is, if it is determined that the liquid ejection head 56C, the liquid ejection head 56M, the liquid ejection head 56Y, and the liquid ejection head 56K do not reach the head retracting position, the head first moving step S102 and the first wiping step S104 are continued.

On the other hand, if the head retracting position reach determining step S106 makes a YES determination, that is, if it is determined that the liquid ejection head 56C, the liquid ejection head 56M, the liquid ejection head 56Y, and the liquid ejection head 56K reach the head retracting position, a head second moving step S108 is performed.

The head second moving step S108, a second wiping step S110, and a capping position reach determining step S112 illustrated in FIG. 14 correspond to the head second moving step S18, the second wiping step S20, and capping position reach determining step S22 illustrated in FIG. 10, respectively.

Action and Effect

According to the liquid ejection device including the maintenance unit 140A illustrated in FIG. 13, it is not necessary to, during the maintenance of the liquid ejection head 56C, the liquid ejection head 56M, the liquid ejection head 56Y, and liquid ejection head 56K, arrange the liquid ejection head 56C, the liquid ejection head 56M, the liquid ejection head 56Y, and the liquid ejection head 56K in an image drawing area where the image drawing is performed using the image drawing unit 18.

In general, since the drying treatment sections for performing the drying treatment are arranged before and after the image drawing unit 18, the image drawing unit 18 may be heated to a high temperature by a heat generated from the drying treatment section in some cases, which suppresses drying deterioration of the liquid ejection head 56C, the liquid ejection head 56M, the liquid ejection head 56Y, and the liquid ejection head 56K caused by the heat around the image drawing unit 18 during the maintenance of the liquid ejection head 56C, the liquid ejection head 56M, the liquid ejection head 56Y, and the liquid ejection head 56K.

Third Embodiment

Next, a description is given of a third embodiment. In the following description, a difference from the second embodiment is mainly explained. The description of the same configuration as the first and second embodiments is appropriately omitted.

Figure 15:
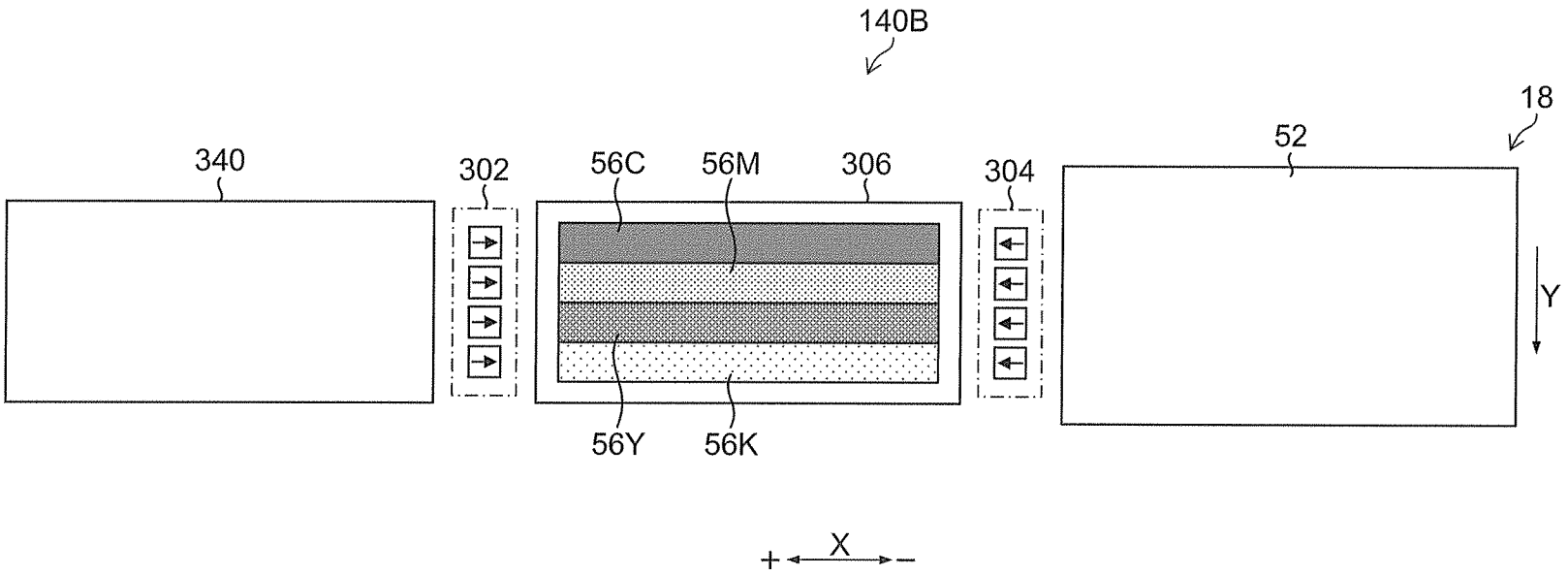
FIG. 15 is a schematic view illustrating an arrangement of a maintenance unit according to a third embodiment.

FIG. 15 is a schematic view illustrating an arrangement of a maintenance unit according to the third embodiment. FIG. 15 is, similarly to FIG. 7, a view around a maintenance unit 140B and the image drawing unit 18 viewed from the upper side of the inkjet recording apparatus 10 illustrated in FIG. 1.

The maintenance unit 140B illustrated in FIG. 15 has arranged therein the first wiping unit 302 on a side of the capping unit 306 closer to the head retracting unit 340 in the head moving direction.

The maintenance unit 140B has arranged therein the second wiping unit 304 on a side of the capping unit 306 closer to the image drawing unit 18 in the head moving direction. A positive direction of the head moving direction in the maintenance unit 140B illustrated in FIG. 15 is a direction from the capping unit 306 toward the head retracting unit 340. A negative direction of the head moving direction is a direction from the head retracting unit 340 toward the capping unit 306.

Figure 16:
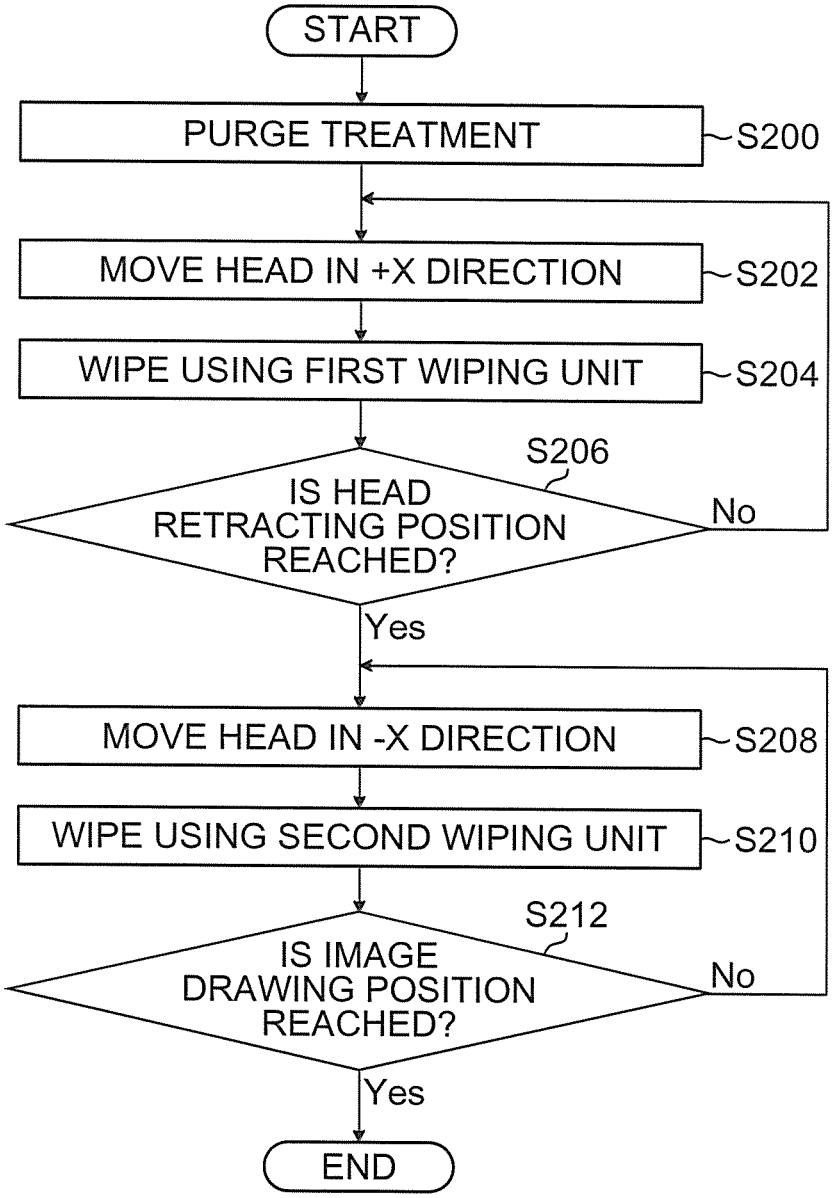
FIG. 16 is a flowchart illustrating a procedure of a cleaning method according to the third embodiment.

FIG. 16 is a flowchart illustrating a procedure of a cleaning method according to the third embodiment. The flowchart illustrated in FIG. 16 shows an image drawing position reach determining step S212 in place of the capping position reach determining step 5112 illustrated in FIG. 14.

A purging step S200, a head first moving step S202, a first wiping step S204, a head retracting position reach determining step S206, a head second moving step S208, and a second wiping step S210 in FIG. 16 correspond to the purging step S100, the head first moving step S102, the first wiping step S104, the head retracting position reach determining step S106, the head second moving step S108, and the second wiping step S110 illustrated in FIG. 14, respectively.

In other words, in the cleaning method according to the third embodiment, the first wiping step S204 is performed in moving the liquid ejection head 56C, the liquid ejection head 56M, the liquid ejection head 56Y, and the liquid ejection head 56K from the capping unit 306 to the head retracting unit 340 in the positive direction of the head moving direction.

The second wiping step S210 is performed in moving the liquid ejection head 56C, the liquid ejection head 56M, the liquid ejection head 56Y, and the liquid ejection head 56K from the head retracting unit 340 through the capping unit 306 to the image drawing unit 18 in the negative direction of the head moving direction.

According to the liquid ejection device including the maintenance unit 140B illustrated in FIG. 15, after performing the second wiping step S210, the liquid ejection head 56C, the liquid ejection head 56M, the liquid ejection head 56Y, and the liquid ejection head 56K are moved to the image drawing area where the image drawing is performed using the image drawing unit 18, allowing the image drawing to be performed immediately after the maintenance process is completed.

Fourth Embodiment

Next, a description is given of a fourth embodiment. In the following description, a difference from the third embodiment is mainly explained. The description of the same configuration as the first, second, and third embodiments is appropriately omitted.

Figure 17:
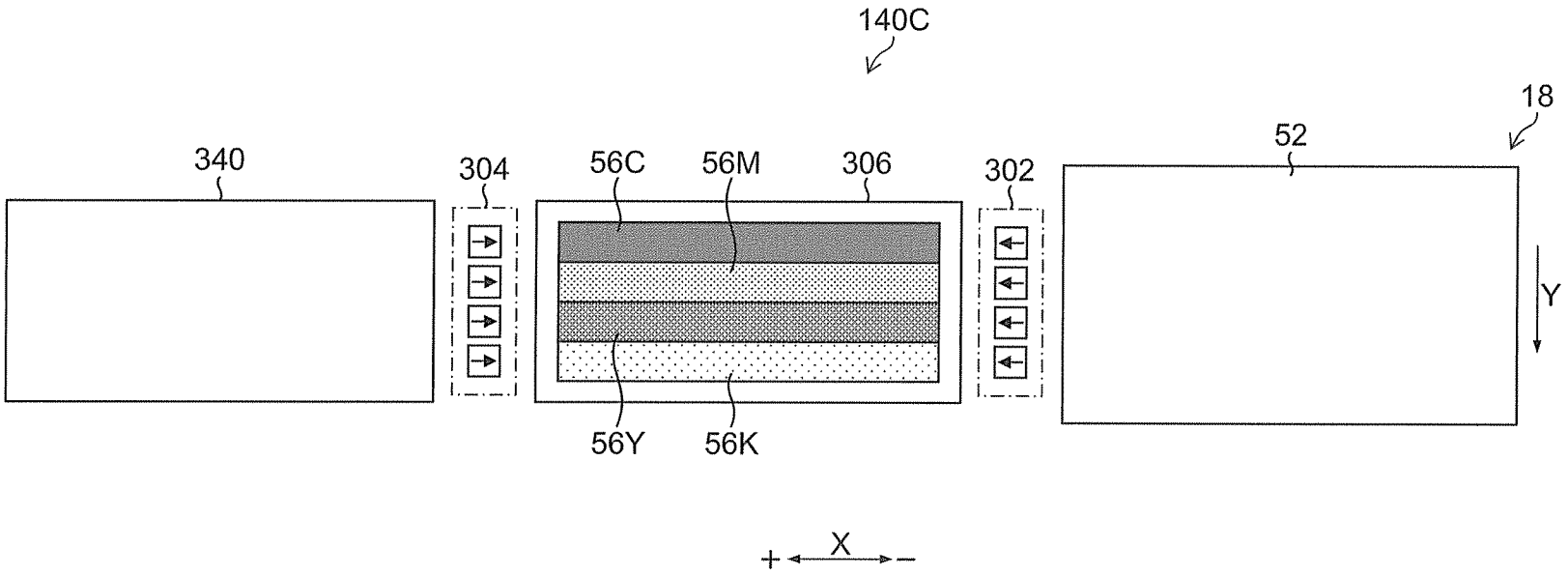
FIG. 17 is a schematic view illustrating an arrangement of a maintenance unit according to a fourth embodiment.

FIG. 17 is a schematic view illustrating an arrangement of a maintenance unit according to the fourth embodiment. FIG. 17 is, similarly to FIG. 7, a view around a maintenance unit 140C and the image drawing unit 18 viewed from the upper side of the inkjet recording apparatus 10 illustrated in FIG. 1.

In the maintenance unit 140C illustrated in FIG. 17, the position of the first wiping unit 302 is replaced with the position of the second wiping unit 304 in the maintenance unit 140B illustrated in FIG. 15.

A positive direction of the head moving direction illustrated in FIG. 17 is a direction from the capping unit 306 toward the image drawing unit 18. A negative direction of the head moving direction is a direction from the capping unit 306 toward the head retracting unit 340.

Figure 18:
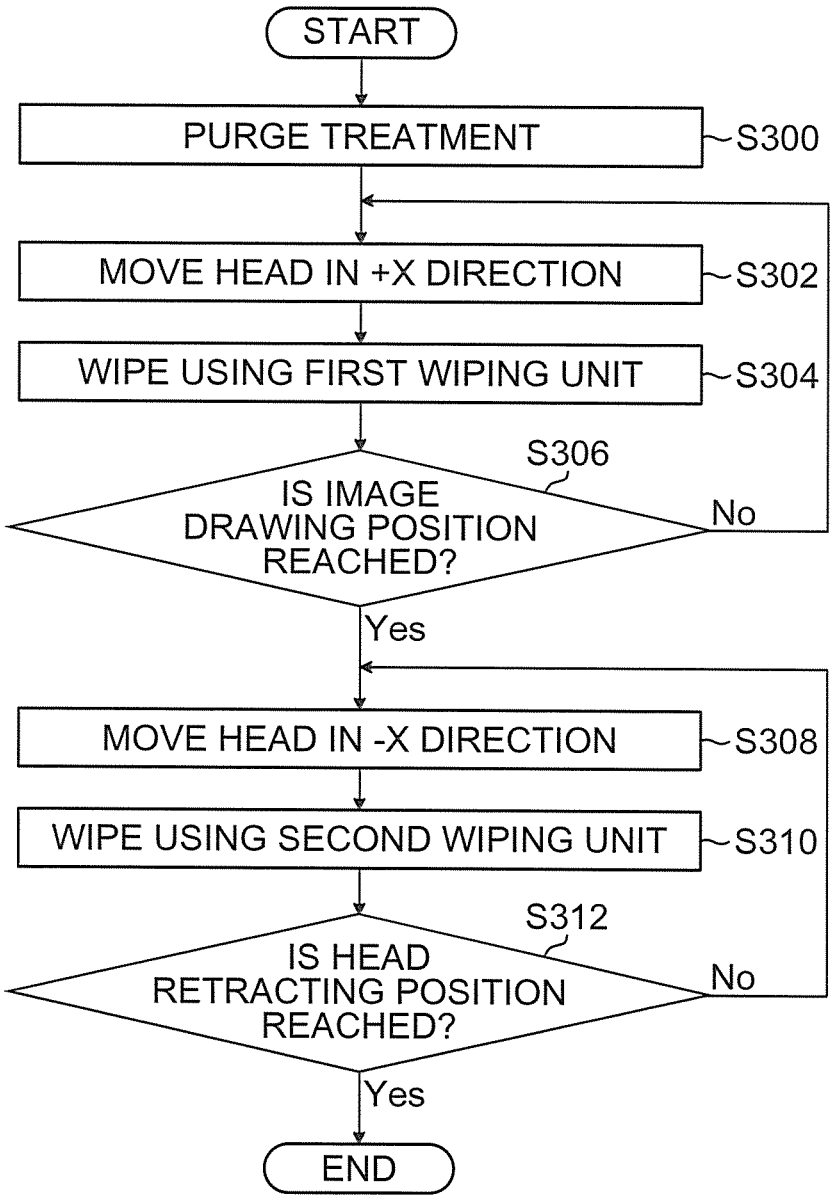
FIG. 18 is a flowchart illustrating a procedure of a cleaning method according to the fourth embodiment.

FIG. 18 is a flowchart illustrating a procedure of a cleaning method according to the fourth embodiment. In the flowchart illustrated in FIG. 18, a first wiping step 5304 illustrated in FIG. 18 is performed in moving the liquid ejection head 56C, the liquid ejection head 56M, the liquid ejection head 56Y, and the liquid ejection head 56K from the capping unit 306 to the image drawing unit 18 illustrated in FIG. 17.

Then, an image drawing position reach determining step S306 illustrated in FIG. 18 is performed in place of the head retracting position reach determining step S206 illustrated in FIG. 16.

In the flowchart illustrated in FIG. 18, a second wiping step S310 illustrated in FIG. 18 is performed in moving the liquid ejection head 56C, the liquid ejection head 56M, the liquid ejection head 56Y, and the liquid ejection head 56K from the capping unit 306 to the head retracting unit 340 illustrated in FIG. 17. Then, a head retracting position reach determining step S312 illustrated in FIG. 18 is performed in place of the image drawing position reach determining step S212 illustrated in FIG. 16.

A purging step 5300, a head first moving step S302, and a head second moving step S308 illustrated in FIG. 18 correspond to the purging step S200, the head first moving step S202, and the head second moving step 5208 illustrated in FIG. 16, respectively.

According to the liquid ejection device including the maintenance unit 140C illustrated in FIG. 17, the second wiping unit 304 can be distanced from a conveyance section of the device. Typically, the second wiping unit 304 performing the final wiping is earlier in consuming the web as compared with the first wiping unit 302.

There may be a case where a maintenance is performed using only the second wiping unit 304. For this reason, the web in the second wiping unit 304 is higher in an exchange frequency than the web 312 in the first wiping unit 302.

According to the configuration illustrated in FIG. 16, the web in the second wiping unit 304 can be exchanged even during performing the image drawing.

Explanation of Modification Example

The first embodiment to the fourth embodiment described above exemplify the web as the wiping member for wiping the ejecting surface, but a blade, a wiper or the like may be applied to the wiping member for wiping the ejecting surface. The web 312 shown in the first embodiment to the fourth embodiment described above is an aspect of the first wiping member. The web in the second wiping unit 304 is an aspect of the second wiping member.

The first embodiment to the fourth embodiment described above exemplify the inkjet recording apparatus having four liquid ejection heads, but the number of the liquid ejection heads may be less or more than four.

The first embodiment to the fourth embodiment described above exemplify the aspect in which each of the four liquid ejection heads is provided with the first wiping unit and the second wiping unit, but the number of the first wiping units and the second wiping units may be less or more than the number of the liquid ejection heads.

In a case where the number of the first wiping units and second wiping units is less than the number of the liquid ejection heads, a configuration may be added in which the first wiping unit and the second wiping unit are moved to the position of the liquid ejection head.

In the embodiments of the present invention described above, the configuration requirements may be appropriately changed, added or deleted without departing from the scope of the present invention. The present invention is not limited to the above-described embodiments, and may be variously modified by a person having ordinary skill in the art within the technical idea of the present invention.

What is claimed is:

1. A liquid ejection device including:

a liquid ejection head having an ejecting surface on which ejection openings each for ejecting a liquid are formed;

a maintenance unit configured to perform maintenance of the liquid ejection head; and a maintenance control unit configured to control an operation of the maintenance unit, wherein the maintenance unit includes:

a first wiping unit that makes a first wiping member travel in a first direction to clean the ejecting surface;

a second wiping unit that makes a second wiping member travel in a second direction which has a component of a direction opposite to the first direction to clean the ejecting surface; and a relative moving unit that moves the first wiping unit and the liquid ejection head relatively to each other and moves the second wiping unit and the liquid ejection head relatively to each other, wherein in cleaning the ejecting surface by use of the first wiping unit, the maintenance control unit moves the first wiping unit and the liquid ejection head relatively to each other, using a direction having a component of the direction opposite to the first direction as a moving direction of the liquid ejection head with reference to the first wiping unit in relative moving between the first wiping unit and the liquid ejection head by use of the relative moving unit, and in cleaning the ejecting surface by use of the second wiping unit, the maintenance control unit moves the second wiping unit and liquid ejection head relatively to each other, using a direction having a component of a direction opposite to the second direction as a moving direction of the liquid ejection head with reference to the second wiping unit in relative moving between the second wiping unit and the liquid ejection head by use of the relative moving unit, to clean the same area on the ejecting surface by the first wiping unit and the second wiping unit.

2. The liquid ejection device according to claim 1, wherein the maintenance unit includes a purge unit that performs a purge treatment on the liquid ejection head, and the first wiping unit, the second wiping unit, and the purge unit are arranged in a relative moving direction of the relative moving unit in an order of the purge unit, the first wiping unit, and the second wiping unit.

3. The liquid ejection device according to claim 2, wherein the maintenance control unit performs the cleaning of the ejecting surface by use of the first wiping unit for the first time after the purge treatment is performed on the liquid ejection head by use of the purge unit, and performs the cleaning of the ejecting surface by use of the second wiping unit after the initial cleaning of the ejecting surface by use of the first wiping unit.

4. The liquid ejection device according to claim 2, wherein the maintenance unit includes a head retracting unit that retracts the liquid ejection head, and the head retracting unit, the first wiping unit, the second wiping unit, and the purge unit are arranged in the relative moving direction of the relative moving unit in an order of the head retracting unit, the second wiping unit, the first wiping unit, and the purge unit.

5. The liquid ejection device according to claim 4, wherein the maintenance control unit performs the cleaning of the ejecting surface by use of the first wiping unit for the first time after the purge treatment is performed on the liquid ejection head by use of the purge unit, and performs, after the initial cleaning of the ejecting surface by use of the first wiping unit, the cleaning of the ejecting surface by use of the second wiping unit after arranging the liquid ejection head in a position of the head retracting unit.

6. The liquid ejection device according to claim 2, wherein a next formula is satisfied:

$$Q_1 \geq Q_2,$$

where $Q_1$ is a first cleaning time period absorption volume that is a liquid absorption volume of the first wiping member during a cleaning time period by use of the first wiping unit, and $Q_2$ is a second cleaning time period absorption volume that is a liquid absorption volume of the second wiping member during a cleaning time period by use of the second wiping unit, and the maintenance control unit performs the cleaning of the ejecting surface by use of the first wiping unit for the first time after the purge treatment is performed on the liquid ejection head by use of the purge unit, and performs the cleaning of the ejecting surface by use of the second wiping unit after the initial cleaning of the ejecting surface by use of the first wiping unit.

7. The liquid ejection device according to claim 6, wherein the first cleaning time period absorption volume $Q_1$ is expressed by a next formula:

$$\{1+(V_{W1}/V_{B1})\}\times A_1\times Q_{01},$$

where $V_{W1}$ is an absolute value of a traveling velocity of the first wiping member in an area where the first wiping member contacts with the ejecting surface, $V_{B1}$ is an absolute value of a relative velocity between the liquid ejection head and the first wiping member in the area where the first wiping member contacts with the ejecting surface, $A_1$ is a nip width that is a length of the first wiping member brought into contact with the ejecting surface in a traveling direction of the first wiping member in cleaning the ejecting surface by use of the first wiping unit, and $Q_{01}$ is an absorption volume of the first wiping member per unit length in the traveling direction of the first wiping member, and the second cleaning time period absorption volume $Q_2$ is expressed by a next formula:

$$\{1+(V_{W2}/V_{B2})\}\times A_2\times Q_{02},$$

where $V_{W2}$ is an absolute value of a traveling velocity of the second wiping member in an area where the second wiping member contacts with the ejecting surface, $V_{B2}$ is an absolute value of a relative velocity between the liquid ejection head and the second wiping member in the area where the second wiping member contacts with the ejecting surface, $A_2$ is a nip width that is a length of the second wiping member brought into contact with the ejecting surface in a traveling direction of the second wiping member in cleaning the ejecting surface by use of the second wiping unit, and $Q_{02}$ is an absorption volume of the second wiping member per unit length in the traveling direction of the second wiping member.

8. The liquid ejection device according to claim 6, wherein the maintenance unit includes a first cleaning liquid applying unit that applies a cleaning liquid to the first wiping member and a second cleaning liquid applying unit that applies the cleaning liquid to the second wiping member, and when the maintenance control unit uses the first cleaning liquid applying unit to apply the cleaning liquid to the first wiping member and uses the second cleaning liquid applying unit to apply the cleaning liquid to the second wiping member, assuming that $P_{1p}$ is a first cleaning liquid application amount that is a cleaning liquid application amount to the first wiping member in the cleaning of the ejecting surface by use of the first wiping unit for the first time after the purge treatment is performed by use of the purge unit, $P_{1n}$ is a second cleaning liquid application amount that is a cleaning liquid application amount to the first wiping member in the cleaning of the ejecting surface by use of the first wiping unit in a case of not performing the purge treatment by use of the purge unit, and $P_{2p}$ is a third cleaning liquid application amount that is a cleaning liquid application amount to the second wiping member in the cleaning of the ejecting surface by use of the second wiping unit in a case of performing the purge treatment by use of the purge unit, a relationship between the first cleaning liquid application amount $P_{1p}$, the second cleaning liquid application amount $P_{1n}$, and the third cleaning liquid application amount $P_{2p}$ satisfies a relationship expressed by a next formula:

$$0 \leq P_{1p} < P_{2p} \leq P_{1n}.$$

9. The liquid ejection device according to claim 8, wherein when the maintenance control unit uses the first cleaning liquid applying unit to apply the cleaning liquid to the first wiping member and uses the second cleaning liquid applying unit to apply the cleaning liquid to the second wiping member, assuming that $P_{2n}$ is a fourth cleaning liquid application amount that is a cleaning liquid application amount to the second wiping member in the cleaning of the ejecting surface by use of the second wiping unit in the case of not performing the purge treatment by use of the purge unit, a relationship between the first cleaning liquid application amount $P_{1p}$, the second cleaning liquid application amount $P_{1n}$, and the fourth cleaning liquid application amount $P_{2n}$ satisfies a relationship expressed by a next formula:

$$0 \leq P_{1p} < P_{2n} \leq P_{1n}.$$

10. A cleaning method for cleaning a liquid ejection head having an ejecting surface on which ejection openings each for ejecting a liquid are formed, comprising:

a first wiping step of moving the liquid ejection head and a first wiping unit relatively to each other to clean the ejecting surface, the first wiping unit making a first wiping member travel in a first direction; and a second wiping step of moving the liquid ejection head and a second wiping unit relatively to each other to clean the ejecting surface, the second wiping unit making a second wiping member travel in a second direction which has a component of a direction opposite to the first direction, wherein in the first wiping step, the first wiping unit and the liquid ejection head are moved relatively to each other, using a direction having a component of the direction opposite to the first direction as a moving direction of the liquid ejection head with reference to the first wiping unit in relative moving between the first wiping unit and the liquid ejection head, in the second wiping step, the second wiping unit and liquid ejection head are moved relatively to each other, using a direction having a component of a direction opposite to the second direction as a moving direction of the liquid ejection head with reference to the second wiping unit in relative moving between the second wiping unit and the liquid ejection head, and in the first wiping step and the second wiping step, the first wiping unit and the second wiping unit are used to clean the same area on the ejecting surface.

11. The cleaning method according to claim 10, further comprising: a purging step of performing a purge treatment on the liquid ejection head, wherein the first wiping step and the purging step are performed in an order of the first wiping step and the purging step in a case where the first wiping unit and the liquid ejection head are moved relatively to each other, using a direction having a component of a direction opposite to the first direction as a moving direction of the liquid ejection head with reference to the first wiping unit, and the second wiping step and the purging step are performed in an order of the purging step and the second wiping step in a case where the second wiping unit and liquid ejection head are moved relatively to each other using a direction having a component of a direction opposite to the second direction as a moving direction of the liquid ejection head with reference to the second wiping unit.

12. The cleaning method according to claim 11, wherein a next formula is satisfied $$Q_1 \geq Q_2,$$

where $Q_1$ is a first cleaning time period absorption volume that is a liquid absorption volume of the first wiping member during a cleaning time period in the first wiping step, and $Q_2$ is a second cleaning time period absorption volume that is a liquid absorption volume of the second wiping member during a cleaning time period in the second wiping step, and after the purging step is performed, the first wiping step is firstly performed, and after the first wiping step performed firstly, the second wiping step is performed.

13. The cleaning method according to claim 12, wherein in the first wiping step, the first cleaning time period absorption volume $Q_1$ is expressed by a next formula:

$$\{1+(V_{W1}/V_{B1})\}\times A_1\times Q_{01},$$

wherein $V_{W1}$ is an absolute value of a traveling velocity of the first wiping member in an area where the first wiping member contacts with the ejecting surface, $V_{B1}$ is an absolute value of a relative velocity between the liquid ejection head and the first wiping member in the area where the first wiping member contacts with the ejecting surface, $A_1$ is a nip width that is a length of the first wiping member brought into contact with the ejecting surface in a traveling direction of the first wiping member in the first wiping step, and $Q_{01}$ is an absorption volume of the first wiping member per unit length in the traveling direction of the first wiping member, and in the second wiping step, the second cleaning time period absorption volume $Q_2$ is expressed by a next formula:

$$\{1+(V_{W2}/V_{B2})\}\times A_2\times Q_{02},$$

where $V_{W2}$ is an absolute value of a traveling velocity of the second wiping member in an area where the second wiping member contacts with the ejecting surface, $V_{B2}$ is an absolute value of a relative velocity between the liquid ejection head and the second wiping member in the area where the second wiping member contacts with the ejecting surface, $A_2$ is a nip width that is a length of the second wiping member brought into contact with the ejecting surface in a traveling direction of the second wiping member in the second wiping step, and $Q_{02}$ is an absorption volume of the second wiping member per unit length in the traveling direction of the second wiping member.

14. The cleaning method according to claim 12, further comprising: a cleaning liquid applying step of applying a cleaning liquid to the first wiping member and the second wiping member, wherein in the cleaning liquid applying step, a next formula is satisfied:

$$0 \leq P_{1p} < P_{2p} \leq P_{1n},$$

where $P_{1p}$ is a first cleaning liquid application amount that is a cleaning liquid application amount to the first wiping member in the first wiping step for the first time after the purging step is performed, $P_{1n}$ is a second cleaning liquid application amount that is a cleaning liquid application amount to the first wiping member in the first wiping step in a case of not performing the purging step, and $P_{2p}$ is a third cleaning liquid application amount that is a cleaning liquid application amount to the second wiping member in the second wiping step in a case of performing the purging step.

15. The cleaning method according to claim 14, wherein in the cleaning liquid applying step, in applying the cleaning liquid to the first wiping member and applying the cleaning liquid to the second wiping member, assuming that $P_{2n}$ is a fourth cleaning liquid application amount that is a cleaning liquid application amount to the second wiping member in the cleaning of the ejecting surface by use of the second wiping unit in a case of not performing the purging step, a relationship between the first cleaning liquid application amount $P_{1p}$, the second cleaning liquid application amount $P_{1n}$, and the fourth cleaning liquid application amount $P_{2n}$ satisfies a relationship expressed by a next formula:

$$0 \leq P_{1p} < P_{2n} \leq P_{1n}.$$

* * * * *